US005356769A

United States Patent [19]

Hioki

[11] Patent Number: 5,356,769

[45] Date of Patent: Oct. 18, 1994

[54] METHINE COMPOUND AND SILVER HALIDE LIGHT-SENSITIVE MATERIAL CONTAINING THE METHINE COMPOUND

[75] Inventor: Takanori Hioki, Kanagawa, Japan

[73] Assignee: Fuji Photo Film Co., Ltd., Kanagawa, Japan

[21] Appl. No.: 31,824

[22] Filed: Mar. 16, 1993

[30] Foreign Application Priority Data

Mar. 17, 1992 [JP] Japan ..... 4-090094

[51] Int. Cl.[5] ..... G03C 1/12; G03C 1/20

[52] U.S. Cl. ..... 430/584; 430/592; 430/593; 430/595; 430/944

[58] Field of Search ..... 430/584, 592, 593, 595, 430/944

[56] References Cited

U.S. PATENT DOCUMENTS

| | | | |
|---|---|---|---|
| 4,770,961 | 9/1988 | Tanaka et al. | 430/584 |
| 4,999,282 | 3/1991 | Sato et al. | 430/592 |
| 5,126,235 | 6/1992 | Hioki | 430/584 |
| 5,153,116 | 10/1992 | Metoki et al. | 430/584 |
| 5,166,047 | 11/1992 | Hioki et al. | 430/584 |

*Primary Examiner*—Janet C. Baxter
*Attorney, Agent, or Firm*—Sughrue, Mion, Zinn, Macpeak & Seas

[57] ABSTRACT

Methine compounds of formulas (I), (II) and (III) are disclosed:

(I)

-continued (II)

(III)

wherein $R_3$, $R_5$ and $R_{5a}$ each represents an alkyl group, an aryl group, or a heterocyclic group, and the remaining symbols are defined in the specification. A silver halide light-sensitive material containing at least one of the methine compounds is also disclosed.

2 Claims, No Drawings

METHINE COMPOUND AND SILVER HALIDE LIGHT-SENSITIVE MATERIAL CONTAINING THE METHINE COMPOUND

FIELD OF THE INVENTION

This invention relates to a novel methine compound. It also relates to a silver halide light-sensitive material containing a novel methine compound. More particularly, it relates to a silver halide light-sensitive material which has high sensitivity and high storage stability.

Further, the novel methine compounds of the present invention are useful in the fields of medicine, dyes and optical information recording mediums such as optical disks in addition to being useful in silver halide photographic materials.

BACKGROUND OF THE INVENTION

It is well known that the methine chains of methine compounds may be crosslinked to improve the stability of the methine compounds in solutions.

Conventional crosslinked methine compounds will be illustrated in detail in comparison with the methine compounds of the present invention hereinafter.

Further, it is conventional and well known in the art that sensitizing dyes are added to silver halide emulsions in the preparation of silver halide light-sensitive materials to enlarge the light-sensitive wavelength regions of the silver halide emulsions and to thereby optically sensitize the silver halide emulsions.

Many compounds are known as spectral sensitizing dyes which are used in the above-described sensitization of silver halide emulsions. Examples of such sensitizing dyes include cyanine dyes, merocyanine dyes and xanthene dyes as described in T. H. James, *The Theory of the Photographic Process*, third edition, pp. 198–228, 1966 (Macmillan New York).

When these sensitizing dyes are applied to the silver halide emulsions, not only are the light-sensitive wavelength regions of the silver halide emulsions enlarged, but the following conditions must also be met:

(1) The spectral sensitizing regions must be proper.

(2) The sensitizing efficiency must be good and sufficiently high sensitivity must be obtained.

(3) Fogging must not be caused.

(4) Changes in temperature must not result in significant variations in sensitivity.

(5) The sensitizing dyes must not have any adverse interactions with other additives such as stabilizers, anti-fogging agents, coating aids, color formers, etc.

(6) The sensitivity must not fluctuate when silver halide emulsions containing the sensitizing dyes are stored, particularly when the emulsions are stored under high temperature and humidity conditions.

(7) The sensitizing dyes when added to a particular layer must not diffuse to other light-sensitive layers, because such diffusion can result in color turbidity (color mixing) after processing.

The above-described conditions are important factors in the preparation of silver halide emulsions of silver halide photographic materials. Particularly, it has been highly demanded to meet the above-described conditions (2) and (6) with regard to high sensitivity of silver halides and the improvement of stability of raw samples during storage.

SUMMARY OF THE INVENTION

An object of the present invention is to provide a novel methine compound.

Another object of the present invention is to provide a silver halide photographic material containing said novel methine compound.

A further object of the present invention is to provide a silver halide photographic material which is not prone to fogging.

A still further object of the present invention is to provide a silver halide photographic material whose sensitivity does not fluctuate significantly during storage under high temperature and/or high humidity conditions and which has excellent raw stock storability.

The above-described objects of the present invention have been achieved by providing a compound represented by the following general formula (I), (II) or (III); and a silver halide light-sensitive material containing at least one compound selected from the group consisting of compounds represented by the following general formulas (I), (II) and (III).

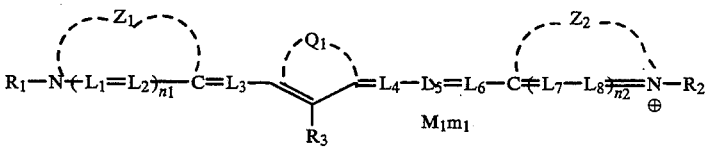

(I)

In general formula (I), $Z_1$ and $Z_2$ each represents a group of atoms required for forming a five-membered or six-membered nitrogen-containing heterocyclic ring; $R_1$ and $R_2$ each represents an alkyl group; $R_3$ represents an alkyl group, an aryl group or a heterocyclic group; $Q_1$ represents a group of atoms required for forming a five-membered, six-membered or seven-membered ring; $L_1$, $L_2$, $L_3$, $L_4$, $L_5$, $L_6$, $L_7$ and $L_8$ each represents a methine group; $n_1$ and $n_2$ each represents 0 or 1; $M_1$ represents a counter ion for neutralizing charge; and $m_1$ represents a number not less than 0 required for neutralizing charge in the molecule.

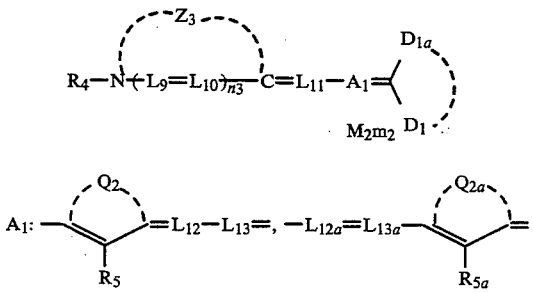

(II)

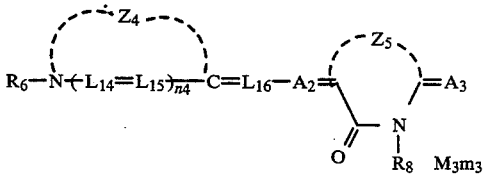

(III)

-continued

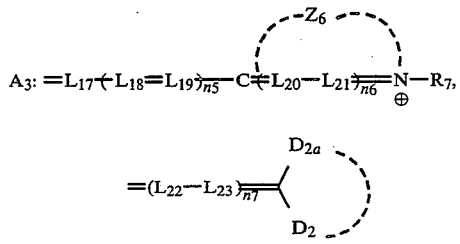

In general formulas (II) and (III), $Z_3$, $Z_4$ and $Z_6$ each has the same meaning as $Z_1$ and $Z_2$; $Z_5$ represents a group of atoms required for forming a five-membered or six-membered nitrogen-containing heterocyclic ring; $Q_2$ and $Q_{2a}$ each has the same meaning as $Q_1$; the moiety consisting of $D_1$ and $D_{1a}$ and the moiety consisting of $D_2$ and $D_{2a}$ each represents a group of atoms required for forming a non-cyclic or cyclic acid nucleus; $R_4$, $R_6$ and $R_7$ each have the same meaning as $R_1$ and $R_2$; $R_8$ represents an alkyl group, an aryl group or a heterocyclic group; $R_5$ and $R_{5a}$ have each the same meaning as $R_3$; $L_9$, $L_{10}$, $L_{11}$, $L_{12}$, $L_{13}$, $L_{12a}$, $L_{13a}$, $L_{14}$, $L_{15}$, $L_{16}$, $L_{17}$, $L_{18}$, $L_{19}$, $L_{20}$, $L_{21}$, $L_{22}$ and $L_{23}$ each has the same meaning as $L_1$, $L_2$, $L_3$, $L_4$, $L_5$, $L_6$, $L_7$ and $L_8$; $n_3$, $n_4$ and $n_6$ each represents 0 or 1; $n_5$ represents an integer not less than 0; $n_7$ represents an integer not less than 0; $M_2$ and $M_3$ each has the same meaning as $M_1$; $m_2$ and $m_3$ each has the same meaning as $m_1$; and $A_2$ has the same meaning as $A_1$.

Preferably, the silver halide light-sensitive material contains at least one methine compound represented by general formula (I) or (II). Particularly preferably, the silver halide light-sensitive material contains at least one methine compound represented by general formula (I).

DETAILED DESCRIPTION OF THE INVENTION

The compounds represented by general formulas (I), (II) and (III) are described in more detail below.

Preferably, $R_1$, $R_2$, $R_4$, $R_6$, and $R_7$ are each an unsubstituted alkyl group having not more than 18 carbon atoms (e.g., methyl, ethyl, propyl, butyl, pentyl, octyl, decyl, dodecyl, octadecyl) or a substituted alkyl group (examples of substituent groups include a carboxyl group, a sulfo group, a cyano group, a halogen atom (e.g., fluorine, chlorine, bromine), a hydroxyl group, an alkoxycarbonyl group having not more than 8 carbon atoms (e.g., methoxycarbonyl, ethoxycarbonyl, phenoxycarbonyl, benzyloxycarbonyl), an alkoxy group having not more than 8 carbon atoms (e.g., methoxy, ethoxy, benzyloxy, phenethyloxy), a monocyclic aryloxy group having not more than 10 carbon atoms (e.g., phenoxy, p-tolyloxy), an acyloxy group having not more than 3 carbon atoms (e.g., acetyloxy, propionyloxy), an acyl group having not more than 8 carbon atoms (e.g., acetyl, propionyl, benzoyl, mesyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), and an alkyl group having not more than 18 carbon atoms substituted by an aryl group having not more than 10 carbon atoms (e.g., phenyl, 4-chlorophenyl, 4-methylphenyl, β-naphthyl)). More preferably, $R_1$, $R_2$, $R_4$, $R_6$ and $R_7$ are each an unsubstituted alkyl group (e.g., a methyl group, an ethyl group, an n-propyl group, an n-butyl group, an n-pentyl group, an n-hexyl group), a carboxyalkyl group (e.g., a 2-carboxyethyl group, a carboxymethyl group), a sulfoalkyl group (e.g., a 2-sulfoethyl group, a 3-sulfopropyl group, a 4-sulfobutyl group, a 3-sulfobutyl group) or a methanesulfonylcarbamoylmethyl group. $M_1m_1$, $M_2m_2$ and $M_3m_3$ are each present in the respective formulas to show the presence or absence of a charge-balancing cation or an anion when the neutralization of an ion charge of a dye is required. Whether a dye is a cation or an anion or has a net ionic charge depends upon the auxochrome and the substituent groups. Typical examples of charge-balancing cations include inorganic and organic ammonium ions and alkali metal ions. Charge-balancing anions include inorganic anions and organic anions. Examples of charge-balancing anions include a halogen anion (e.g., a fluoride ion, a chloride ion, a bromide ion, an iodide ion), a substituted arylsulfonate ion (e.g., p-toluene sulfonate ion, p-chlorobenzenesulfonate ion), an aryldisulfonate ion (e.g., 1,3-benzenedisulfonate ion, 1,5-naphthalenedisulfonate ion, 2,6-naphthalenedisulfonate ion), an alkylsulfate ion (e.g., methylsulfate ion), a sulfate ion, a thiocyanate ion, a perchlorate ion, a tetrafluoroborate ion, a picrate ion, an acetate ion and a trifluoromethanesulfonate ion.

Among them, an ammonium ion, an iodide ion and a p-toluenesulfonate ion are preferred.

Examples of the nuclei formed by $Z_1$, $Z_2$, $Z_3$, $Z_4$ and $Z_6$, respectively include a thiazole nucleus (e.g., a thiazole nucleus (e.g., thiazole, 4-methylthiazole, 4-phenylthiazole, 4,5-dimethylthiazole, 4,5-diphenylthiazole), a benzthiazole nucleus (e.g., benzthiazole, 4-chlorobenzthiazole, 5-chlorobenzthiazole, 6-chlorobenzthiazole, 5-nitrobenzthiazole, 4-methylbenzthiazole, 5-methylthiobenzthiazole, 5-methylbenzthiazole, 6-methylthiobenzthiazole, 5-bromobenzthiazole, 6-bromobenzthiazole, 5-iodobenzthiazole, 5-phenylbenzthiazole, 5-methoxybenzthiazole, 6-methoxybenzthiazole, 6-methylthiobenzthiazole, 5-ethoxybenzthiazole, 5-ethoxycarbonylbenzthiazole, 5-carboxybenzthiazole, 5-phenethylbenzthiazole, 5-fluorobenzthiazole, 5-chloro-6-methylbenzthiazole, 5,6-dimethylbenzthiazole, 5,6-dimethylthiobenzthiazole, 5,6-dimethoxylbenzthiazole, 5-hydroxy-6-methylbenzthiazole, tetrahydrobenzthiazole, 4-phenylbenzthiazole), a naphthothiazole nucleus (e.g., naphtho-[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole)), a thiazoline nucleus (e.g., thiazoline, 4-methylthiazoline, 4-nitrothiazoline), an oxazole nucleus (e.g., an oxazole nucleus (e.g., oxazole, 4-methyloxazole, 4-nitrooxazole, 5-methyloxazole, 4-phenyloxazole, 4,5-diphenyloxazole, 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole), a naphthoxazole nucleus (e.g., naphtho[2,1-d]oxazole, naphtho[1,2-d]oxazole, naphtho[2,3-d]oxazole, 5-nitronaphtho[2,1-d]oxazole)), an oxazoline nucleus (e.g., 4,4-dimethyloxazoline), a selenazole nucleus (e.g., a selenazole nucleus (e.g., 4-methylselenazole, 4-nitroselenazole, 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), a naphthoselenazole nucleus (e.g., naphtho[2,1-d]selenazole, naphtho[1,2-d]-selenazole)), a selenazoline nucleus (e.g., selenazoline, 4-methylselenazoline ), a tellurazole nucleus (e.g., a tellurazole nucleus (e.g., tellurazole, 4-methyltellurazole, 4-phenyltellurazole), a benzotellurazole nucleus (e.g., benzotellurazole, 5-chlorobenzotellurazole, 5-methylbenzotellurazole, 5,6-dimethylbenzotellurazole, 6-methylbenzotellurazole), a naphthotellurazole nucleus (e.g., naphtho[2,1-d]tellurazole, naphtho-[1,2-d]tellurazole)), a tellurazoline nucleus (e.g., tellurazoline, 4-methyltellurazoline), a 3,3-diallylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine), an imidazole nucleus (e.g., an imidazole nucleus (e.g., 1-alkylimidazole, 1-alkyl-4-phenylimidazole, 1-arylimidazole), a benzimidazole nucleus (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole), a naphthoimidazole nucleus (e.g., 1-alkyl-naphtho[1,2-d]imidazole, 1-aryl-naphtho-[1,2-d]imidazole, the alkyl group preferably being an unsubstituted alkyl group having 1 to 8 carbon atoms such as methyl, ethyl, propyl, isopropyl or butyl or a hydroxyalkyl group such as 2-hydroxyethyl or 3-hydroxypropyl with a methyl group and an ethyl group being particularly preferred, and the aryl group being a phenyl group, a halogen (e.g., chloro) substituted phenyl group, an alkyl (e.g., methyl)-substituted phenyl group or an alkoxy (e.g., methoxy)-substituted phenyl group), a pyridine nucleus (e.g., 2-pyridine, 4-pyridine, 5-methyl-2-pyridine, 3-methyl-4-pyridine), a quinoline nucleus (e.g., a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline), an isoquinoline nucleus (e.g., 6-nitro-1-isoquinoline, 3,4-dihydro-1-isoquinoline, 6-nitro-1-isoquinoline)), an imidazo[4,5-b]quinoxaline nucleus (e.g., 1,3-diethylimidazo[4,5-b]quinoxaline, 6-chloro-1,3-diallylimidazo[4,5-b]quinoxaline), an oxadiazole nucleus, a thiadiazole nucleus, a tetrazole nucleus and a pyrimidine nucleus.

Among the respective nuclei formed by $Z_1$, $Z_2$, $Z_3$, $Z_4$ and $Z_6$, a benzthiazole nucleus, a naphthothiazole nucleus, a benzoxazole nucleus, a naphthoxazole nucleus, a benzimidazole nucleus, a 2-quinoline nucleus and a 4-quinoline nucleus are preferred.

$Q_1$, $Q_2$ and $Q_{2a}$ each represents a group of atoms required for forming a five-membered, six-membered or seven-membered ring. A six-membered ring is particularly preferred. These rings may be substituted.

Preferred examples of suitable substituent groups include a substituted or unsubstituted alkyl group (e.g., methyl, ethyl, propyl, butyl, hydroxyethyl, trifluoromethyl, benzyl, sulfopropyl, diethylaminoethyl, cyanopropyl, adamantyl, p-chlorophenethyl, ethoxyethyl, ethylthioethyl, phenoxyethyl, carbamoylethyl, carboxyethyl, ethoxycarbonylmethyl, acetylaminoethyl), an unsubstituted or substituted alkenyl group (e.g., allyl, styryl), an unsubstituted or substituted aryl group (e.g., phenyl, naphthyl, p-carboxyphenyl, 3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, p-anisyl, o-anisyl, p-cyanophenyl, p-N-methylureidophenyl, m-fluorophenyl, p-tolyl, m-tolyl), an optionally substituted heterocyclic group (e.g., pyridyl, 5-methyl-2-pyridyl, thienyl), a halogen atom (e.g., chlorine, bromine, fluorine), a mercapto group, a cyano group, a carboxyl group, a sulfo group, a hydroxy group, a carbamoyl group, a sulfamoyl group, an amino group, a nitro group, an optionally substituted alkoxy group (e.g., methoxy, ethoxy, 2-methoxyethoxy, 2-phenylethoxy), an optionally substituted aryloxy group (e.g., phenoxy, p-methylphenoxy, p-chlorophenoxy), an acyl group (e.g., acetyl, benzoyl), an acylamino group (e.g., acetylamino, caproylamino), a sulfonyl group (e.g., methanesulfonyl, benzenesulfonyl), a sulfonylamido group (e.g., methanesulfonylamido, benzenesulfonylamido), a substituted amino group (e.g., diethylamino, hydroxyamino), an alkyl- or arylthio group (e.g., methylthio, carboxyethylthio, sulfobutylthio, phenylthio), an alkoxycarbonyl group (e.g., methoxycarbonyl) and an aryloxycarbonyl group (e.g., phenoxycarbonyl). These substituent groups may be further substituted by one or more of an alkyl group, an alkenyl group, an aryl group, a hydroxy group, a carboxyl group, a sulfo group, a nitro group, a cyano group, a halogen atom, an alkoxy group, an aryloxy group, an alkoxycarbonyl group, an acyl group, an acylamino group, a sulfonamino group, a carbamoyl group and a sulfamoyl group.

Among these substituent groups, an unsubstituted alkyl group (e.g., methyl, ethyl) and an unsubstituted aryl group (e.g., a phenyl group) are more preferred.

$L_1$ to $L_{23}$ each represents an unsubstituted methine group or a substituted methine group (a methine group substituted, for example, by one or more of a substituted or unsubstituted alkyl group (e.g., a methyl group, an ethyl group, a 2-carboxyethyl group), a substituted or unsubstituted aryl group (e.g., a phenyl group, an o-carboxyphenyl group), a heterocyclic group (e.g., barbituric acid), a halogen atom (e.g., a chlorine atom, a bromine atom), an alkoxy group (e.g., a methoxy group, an ethoxy group), an amino group (e.g., an N,N-diphenylamino group, an N-methyl-N-phenylamino group, an N-methylpiperadino group), and an alkylthio group (e.g., a methylthio group, an ethylthio group)), or one or more of $L_1$ to $L_{23}$ may form a ring together with one or more other methine groups or may form a ring together with an auxochrome.

Preferably, $L_1$ to $L_{23}$ each represents an unsubstituted methine group.

Preferably, $R_3$, $R_5$ and $R_{5a}$ each represents an unsubstituted alkyl group having 1 to 18 carbon atoms, preferably 1 to 7 carbon atoms, particularly preferably 1 to 4 carbon atoms (e.g., methyl, ethyl, propyl, isopropyl, butyl, isobutyl, hexyl, octyl, dodecyl, octadecyl), a substituted alkyl group (e.g., an aralkyl group (e.g., benzyl, 2-phenylethyl), a hydroxyalkyl group (e.g., 2-hydroxyethyl, 3-hydroxypropyl ), a carboxyalkyl group (e.g., 2-carboxyethyl, 3-carboxypropyl, 4-carboxybutyl, carboxymethyl), an alkoxyalkyl group (e.g., 2-methyoxyethyl, 2-(2-methoxyethoxy)ethyl), a sulfoalkyl group (e.g., 2-sulfoethyl, 3-sulfopropyl, 3-sulfobutyl, 4-sulfobutyl, 2-[3-sulfopropoxy]ethyl, 2hydroxy-3-sulfopropyl, 3-sulfopropoxyethoxyethyl), a sulfatoalkyl group (e.g., 3-sulfatopropyl, 4-sulfatobutyl), a heterocyclic group-substituted alkyl group (e.g., 2-(pyrrolidine-2-one-1-yl)-ethyl, tetrahydrofurfuryl, 2-morpholinoethyl), 2-acetoxyethyl, carbomethyloxymethyl, oxymethyl, 2-methanesulfonylaminoethyl)), an allyl group, an unsubstituted aryl group (e.g., phenyl, 2-napthyl, a substituted aryl group (e.g., 4-carboxyphenyl, 4-sulfophenyl, 3-chlorophenyl, 3-methylphenyl), or a heterocyclic group (e.g., 2-pyridyl, 2-thiazolyl).

More preferably, $R_3$, $R_5$ and $R_{5a}$ each represents an unsubstituted alkyl group, with a methyl group and an ethyl group being particularly preferred.

The moiety consisting of $D_1$ and $D_{1a}$ and the moiety consisting of $D_2$ and $D_{2a}$ each represents a group of atoms required for forming an acid nucleus. Each such moiety may be in the form of any of the acid nuclei of conventional merocyanine dyes. The term "acid nucleus" as used herein refers to an acid nucleus as defined, for example, by T. H. James, *The Theory of the Photographic Process*, fourth edition, page 198 (Macmillan, N.Y., 1977). In a preferred embodiment, examples of substituent groups which participate in the resonance of $D_1$ and $D_2$ include a carbonyl group, a cyano group, a sulfonyl group and a sulfenyl group. $D_{1a}$ and $D_{2a}$ each represents a residue of a group of atoms required for forming an acid nucleus.

Specific examples of acid nuclei include those described in U.S. Pat. Nos. 3,567,719, 3,575,869, 3,804,634, 3,837,862, 4,002,480 and 4,925,777 and JP-A-3-167546 (the term "JP-A" as used herein means an "unexamined published Japanese patent application").

When the acid nucleus is non-cyclic, the terminal of the methine bond is a group such as a malononitrile group, an alkanesulfonylacetonitrile group, a cyanomethyl benzofuranyl ketone group or a cyanomethyl phenyl ketone group.

When an acid nucleus moiety consisting of $D_1$ and $D_{1a}$ and/or an acid nucleus moiety consisting of $D_2$ and $D_{2a}$ is cyclic, each such cyclic moiety forms a five-membered or six-membered heterocyclic ring comprising carbon, nitrogen and chalcogen (typically oxygen, sulfur, selenium and tellurium) atoms.

Preferred examples of acid nuclei include nuclei of 2-pyrazoline-5-one, pyrazolidine-3,5-dione, imidazoline-5-one, hydantoin, 2- or 4-thiohydantoin, 2-iminooxazolidine-4-one, 2-oxazoline-5-one, 2-thiooxazolidine-2,4-dione, isoxazoline-5-one, 2-thiazoline-4-one, thiazolidine-4-one, thiazolidine-2,4-dione, rhodanine, thiazolidine-2,4-dithione, isorhodanine, indane-1,3-dione, thiophene-3-one, thiophene-3-one-1,1-dioxide, indoline-2-one, indoline-3-one, indazoline-3-one, 2-oxoindazolium, 3-oxoindazolium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one and pyrido[1,2-a]pyrimidine-1,3-dione.

More preferred are nuclei of 3-alkylrhodanine, 3-alkyl-2-thiooxazolidine-2,4-dione and 3-alkyl-2-thiohydantoin.

Substituent group attached to nitrogen atom as a member of the nucleus includes hydrogen atom, an alkyl group, an aryl group or a heterocyclic group, preferably includes those described in the definition of $R_3$, $R_5$ and $R_7$. $R_8$ preferably includes those described in the definition of $R_3$, $R_5$ and $R_7$.

More preferred examples of them include an unsubstituted alkyl group (e.g., methyl, ethyl, n-propyl, n-butyl, n-pentyl, n-hexyl), a carboxyalkyl group (e.g., carboxymethyl, 2-carboxyethyl) and a sulfoalkyl group (e.g., 2-sulfoethyl).

The five-membered or six-membered nitrogen containing ring formed by $Z_5$ is a ring obtained by removing an oxo group or a thioxo group at an appropriate position from a heterocyclic ring represented by a moiety consisting of $D_1$ and $D_{1a}$ or $D_2$ and $D_{2a}$.

More preferably, the ring formed by $Z_5$ is one obtained by removing a thioxo group from a rhodanine nucleus.

Further, cyanine dyes, merocyanine dyes and complex merocyanine dyes can be used as spectral sensitizing dyes in the present invention. Furthermore, complex cyanine dyes, holopolar cyanine dyes, hemicyanine dyes, styryl dyes and hemioxonol dyes can be used. Examples of cyanine dyes which can be used in the present invention include simple cyanine dyes, carbocyanine dyes, dicarbocyanine dyes and tricarbocyanine dyes.

Typical examples of the methine compounds represented by general formulas (I), (II) and (III) include, but are not limited to, the following compounds.

Compounds of general formula (I)

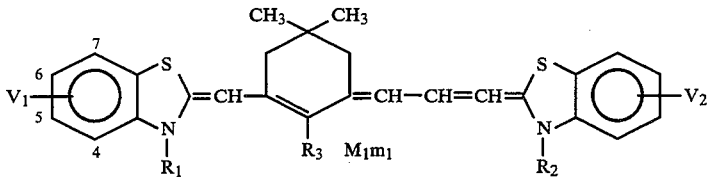

| Compound No. | $R_1$ | $R_2$ | $R_3$ | $V_1$ | $V_2$ | $M_1$ | $m_1$ |
|---|---|---|---|---|---|---|---|
| I-1 | Et | Et | Me | H | H | $I^-$ | 1 |
| I-2 | Et | Et | Me | 6,7-benzo | 6-OMe | $I^-$ | |
| I-3 | $CH_2CO_2H$ | $CH_2CO_2H$ | Me | 6,7-benzo | 5,6-(OMe)$_2$ | $I^-$ | 1 |
| I-4 | Et | $(CH_2)_4SO_3^-$ | Me | H | H | — | — |

-continued

| | | | | | | | |
|---|---|---|---|---|---|---|---|
| I-5 | $(CH_2)_4SO_3^-$ | $(CH_2)_4SO_3^-$ | Et | 5,6-$Me_2$ | 5,6-$Me_2$ | $Na^+$ | 1 |
| I-6 | Et | $CH_2CONH$ \| $SO_2Me$ | Pr | H | H | $Br^-$ | 1 |
| I-7 | $(CH_2)_4CH_3$ | $(CH_2)_2OMe$ | $CH_2CO_2H$ | 6-Me | 5-$CO_2H$ | $Cl^-$ | 1 |
| I-8 | $CH_2CH{=}CH_2$ | Et | Ph | 5-Cl | 6-OEt | $I^-$ | 1 |

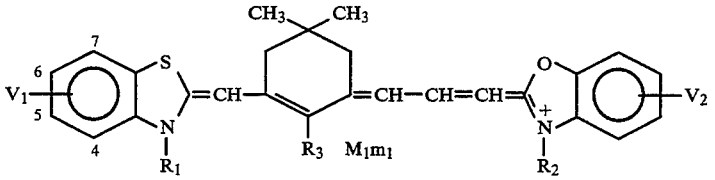

| Compound No. | $R_1$ | $R_2$ | $R_3$ | $V_1$ | $V_2$ | $M_1$ | $m_1$ |
|---|---|---|---|---|---|---|---|
| I-9 | Et | Et | Me | H | H | $I^-$ | 1 |
| I-10 | Et | Et | Me | 5,6-$Me_2$ | 5,6-$Me_2$ | $I^-$ | 1 |
| I-11 | $(CH_2)_2SMe$ | Et | $(CH_2)_4Me$ | 5,6-$Cl_2$ | H | $Cl^-$ | 1 |
| I-12 | $(CH_2)_3SO_3^-$ | $(CH_2)_3SO_3^-$ | Et | 6,7-benzo | 6-Me | $Et_3NH^+$ | 1 |
| I-13 | $(CH_2)_2CN$ | Me | Me | 4-Me | 4-Me | $I^-$ | 1 |
| I-14 | $(CH_2)_2CO_2H$ | $(CH_2)_3CO_2Me$ | Me | H | 6,7-benzo | $Br^-$ | 1 |
| I-15 | $CH_2CONH$ \| $SO_2Me$ | Et | Ph | 7-Me | 7-Me | $Cl^-$ | 1 |
| I-16 | $(CH_2)_2OH$ | $(CH_2)_2OH$ | Me | 5-$CO_2H$ | 6-Me | $I^-$ | 1 |

I-17

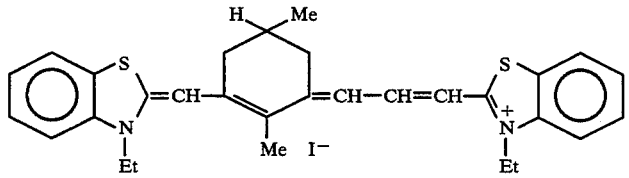

I-18

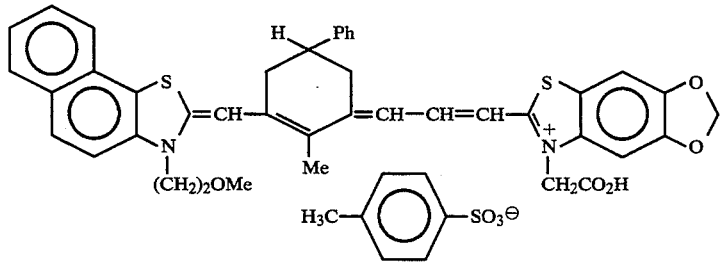

I-19

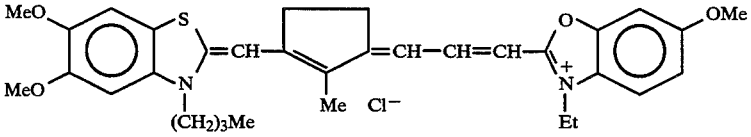

I-20

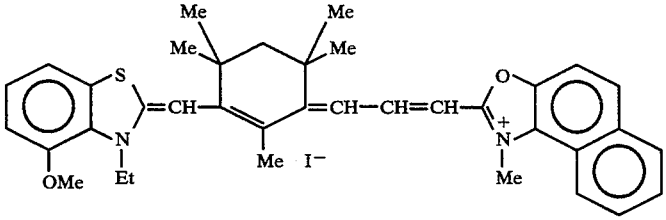

I-21

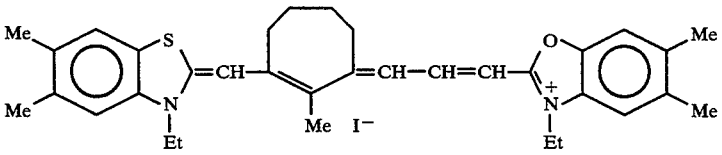

-continued
I-22
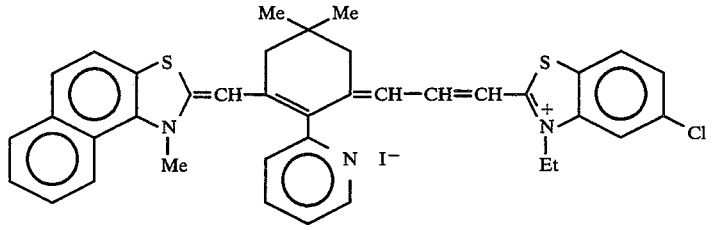
I-23
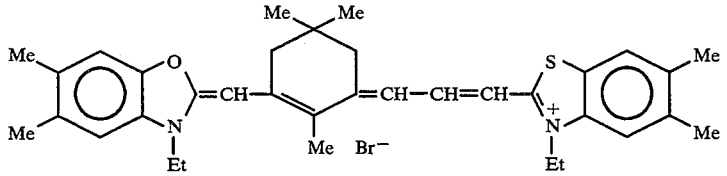
I-24
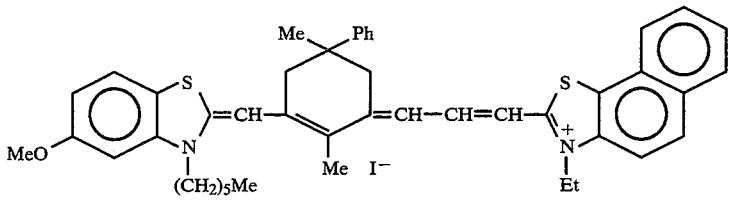
I-25
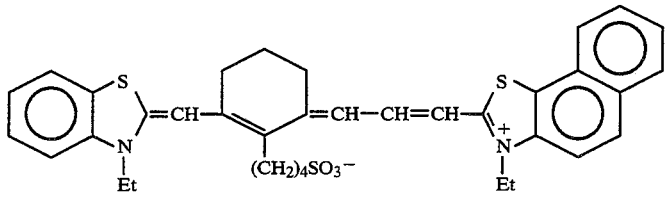
I-26
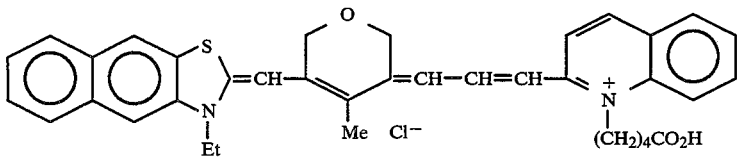
I-27
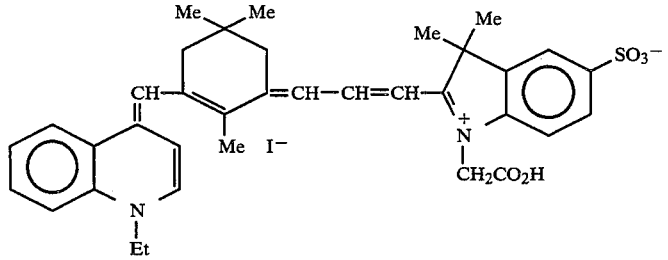
I-28
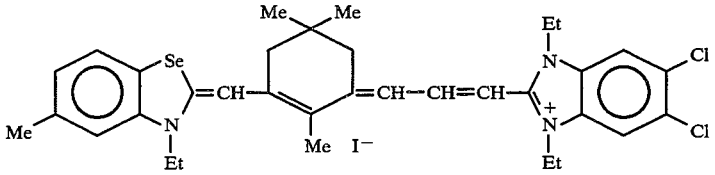
I-29
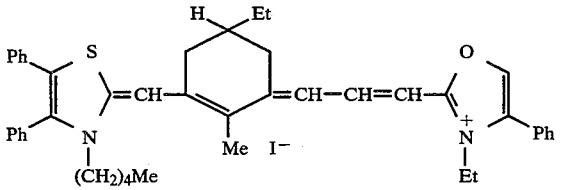

-continued
I-30
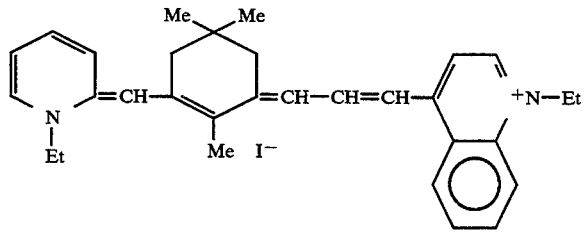
I-31
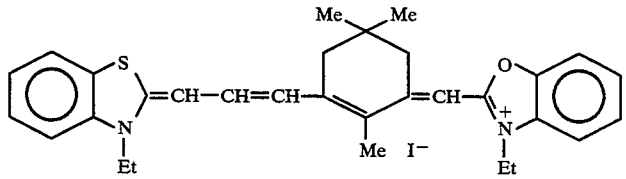
I-32
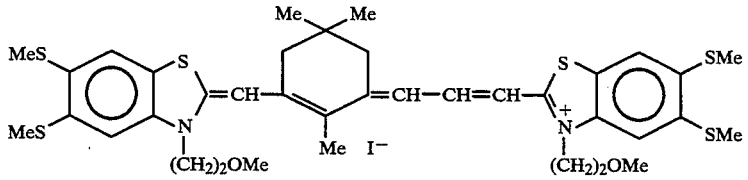
I-33
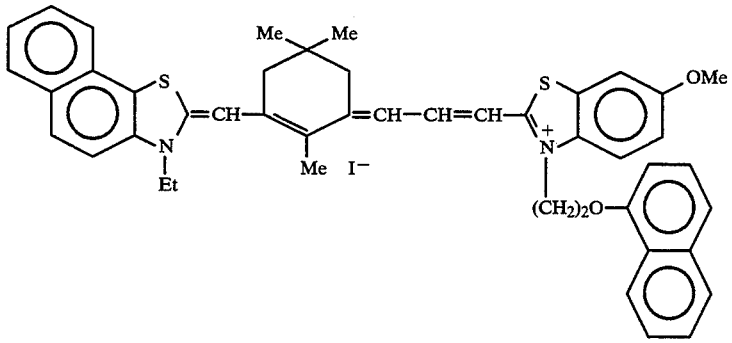
wherein Me = $CH_3$, Et = $C_2H_5$, Pr = $(CH_2)_2CH_3$, Ph = 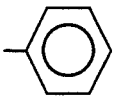
Compounds of general formula (II)
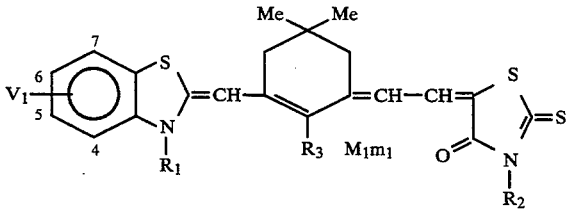
| Compound No. | $R_1$ | $R_2$ | $R_3$ | $V_1$ | $M_1$ | $m_1$ |
|---|---|---|---|---|---|---|
| II-1 | Et | Et | Me | H | — | — |
| II-2 | $(CH_2)_4Me$ | $CH_2CO_2H$ | Et | 6,7-benzo | — | — |
| II-3 | Me | $CH_2CO_2H$ | Ph | 4-Me | — | — |
| II-4 | $(CH_2)_4SO_3^-$ | Pr | Me | 6,7-benzo | $Na^+$ | 1 |
| II-5 | $CH_2CONHSO_2Me$ | Et | Me | 5,6-$Me_2$ | — | — |
| II-6 | $(CH_2)_2OMe$ | $(CH_2)_2SO_3^-$ | $CH_2CO_2H$ | 5,6-$(OMe)_2$ | $K^+$ | 1 |
| II-7 | $(CH_2)_2SMe$ | Et | Me | 5,6-$(SMe)_2$ | — | — |

-continued
| | | | | | | |
|---|---|---|---|---|---|---|
| II-8 | $(CH_2)_2OPh$ | 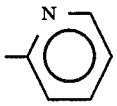 | Me | 6-OMe | — | — |
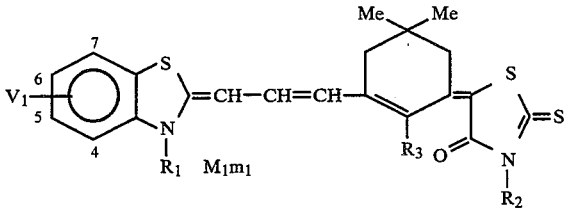
| Compound No. | $R_1$ | $R_2$ | $R_3$ | $V_1$ | $M_1$ | $m_1$ |
|---|---|---|---|---|---|---|
| II-9 | Et | Et | Me | H | — | — |
| II-10 | $CH_2CH{=}CH_2$ | $CH_2CO_2H$ | Et | 5,6-$Me_2$ | — | — |
| II-11 | $(CH_2)_3SO_3^-$ | $(CH_2)_4Me$ | Ph | 6,7-benzo | $Et_3NH^+$ | 1 |
| II-12 | $(CH_2)_2OMe$ | $(CH_2)_2SO_3^-$ | Me | 4-Me | $K^+$ | 1 |
| II-13 | Me | Ph | Et | 6-Cl | — | — |
| II-14 | 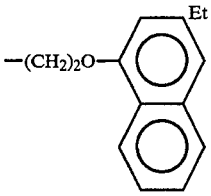 | Et | Me | H | — | — |
II-15
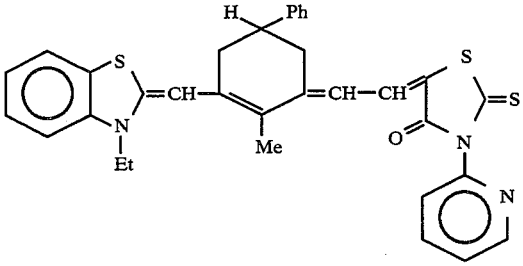
II-16
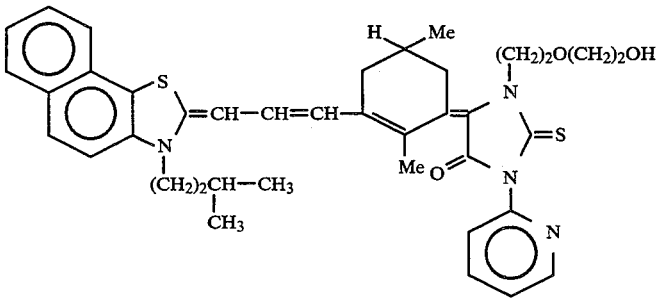
II-17
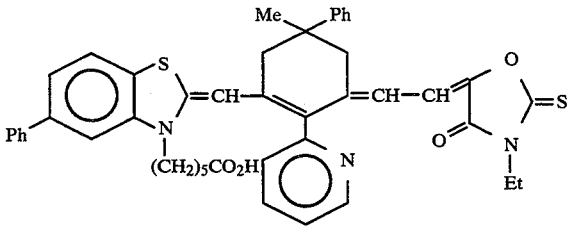

-continued
II-18
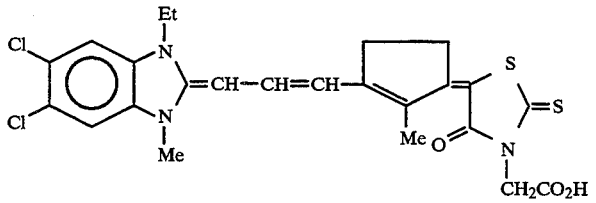
II-19
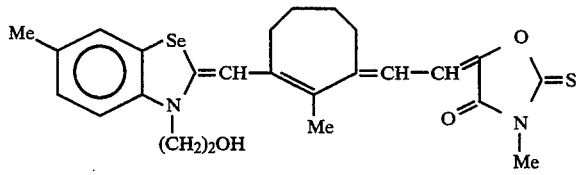
II-20
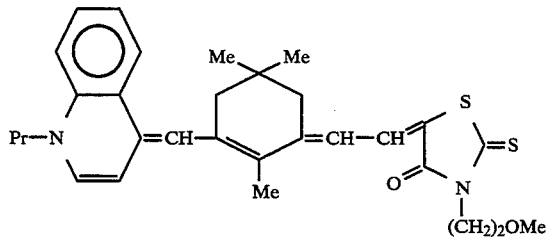
Compounds of the general formula (III)
III-1
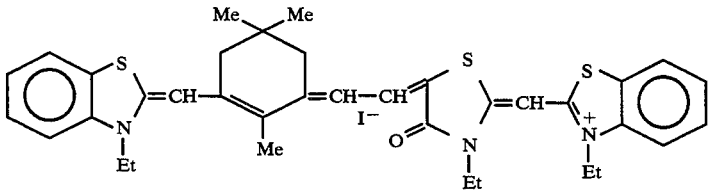
III-2
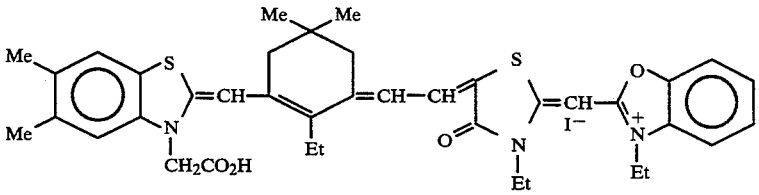
III-3
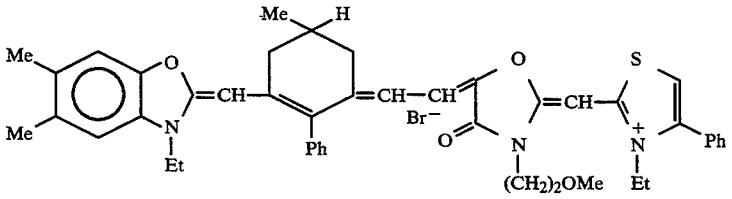
III-4
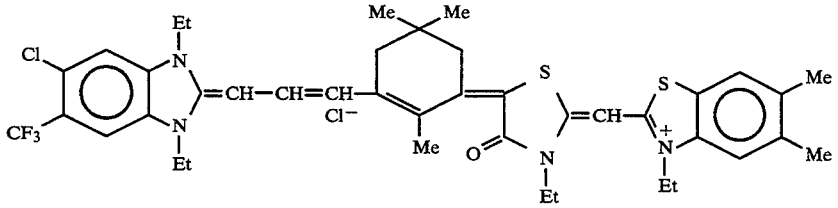

-continued
Compounds of the general formula (III)
III-5
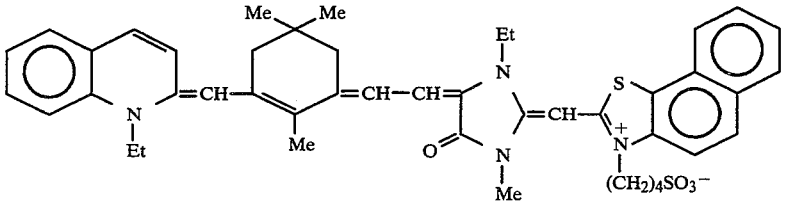
III-6
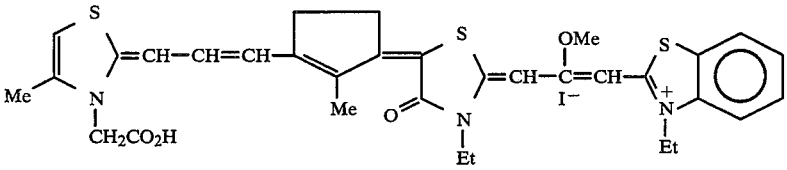
III-7
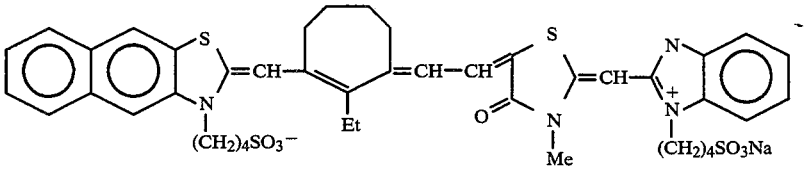
III-8
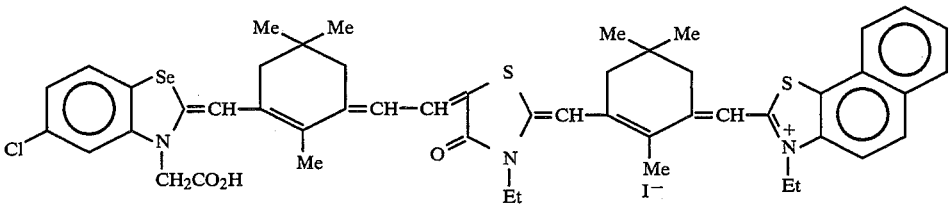
III-9
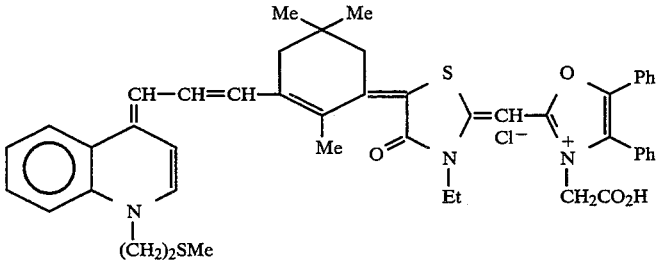
III-10
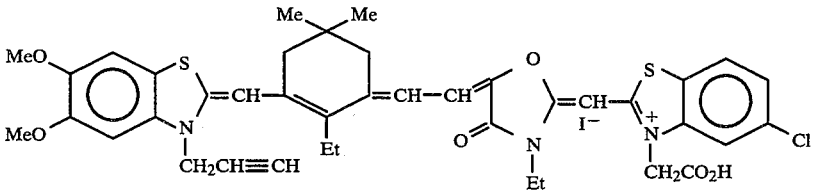
III-11
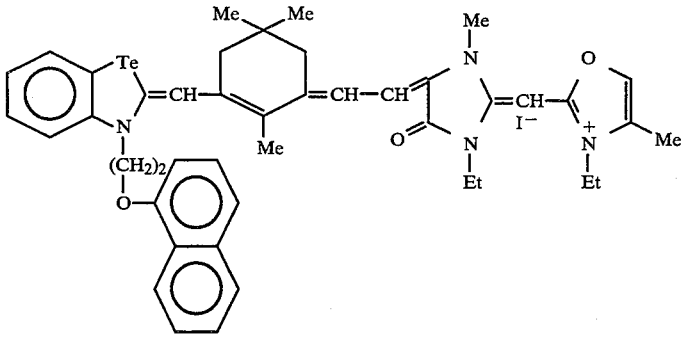

-continued

Compounds of the general formula (III)

III-12

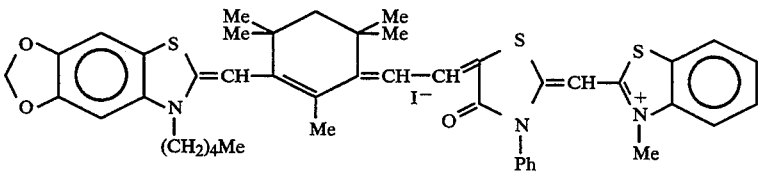

III-13

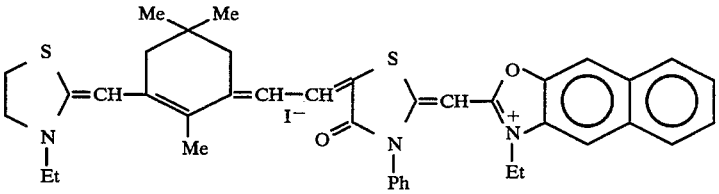

III-14

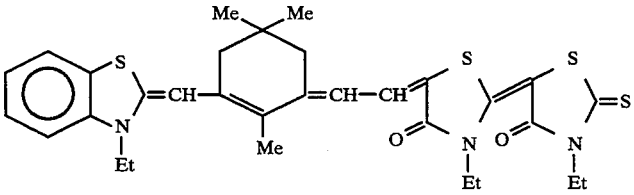

The synthesis of the methine moiety of the methine compounds of the present invention will be illustrated below.

SYNTHESIS EXAMPLE 1

A synthesis was performed according to the route of the following Scheme 1 by referring to *Journal of the Chemical Society*, page 1511 (1964).

Scheme 1

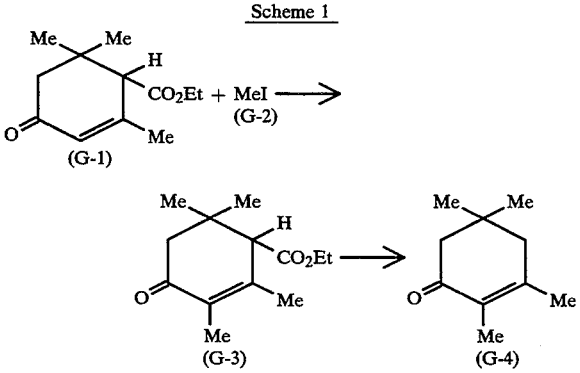

33 g of (G-1) were added dropwise to 250 ml of ethanol and 64.4 g of sodium ethoxide. Subsequently, 94 g of (G-2) were added dropwise thereto.

After the mixture was stirred at room temperature for 24 hours, extraction was conducted by adding 0.8 l of water and 0.5 l of ether. The ether layer was dried over magnesium sulfate. The solvent was distilled off under vacuum, and the residue was purified by means of silica gel chromatography (eluent: ethyl acetate/hexane=1/2) and distilled under reduced pressure.

24.3 g of a colorless liquid (G-3) were obtained (0.43 mmHg/90° C., yield: 69%). After 23 g of (G-3) were refluxed in 52 ml of an ethanol solution of 15% potassium hydroxide for 8 hours, 60 ml of ice water were added thereto and the mixture was acidified with 2N hydrochloric acid. The mixture was stirred at 50° C. for one hour, and extracted with ether. The ether layer was dried over magnesium sulfate, and the solvent was distilled off under reduced pressure. The residue was distilled under reduced pressure to obtain 7.7 g of a colorless liquid (G-4) (0.4 mmHg/45° C., yield: 50%).

SYNTHESIS EXAMPLE 2

In the same manner as in Synthesis Example 1, (G-4) was synthesized according to the route of the following Scheme 2 by referring to *Bulletin de la Societe Chimique de France*, page 690 (1954).

Scheme 2

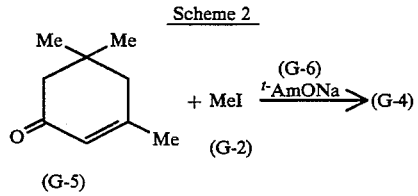

While 138 g of (G-5), 800 ml of ether and 179 g of (G-2) were stirred under cooling with ice, 125 g of (G-6) in 700 ml of benzene were added dropwise thereto. The mixture was stirred at a temperature of not higher than 10° C. for 4 hours. Subsequently, about one liter of the solvent was distilled off under reduced pressure, and 0.6 l of ice water and concentrated hydrochloric acid were added to the residue to acidify it. The mixture was extracted with 600 ml of ethyl acetate. The extract was dried over anhydrous sodium sulfate, and the solvent was distilled off under reduced pressure. The residue was purified by means of silica gel chromatography (eluent: ethyl acetate/hexane=1/2).

65 g (yield: 43%) of (G-4) were obtained.

Various substituent groups ($R_3$, $R_5$, $R_{5a}$) can be introduced by using other alkylating agents in place of methyl iodide (G-2).

A phenyl group can be introduced by referring to *Journal of the Chemical Society*, page 1511 (1964).

The methine compounds of general formulas (I), (II) and (III) according to the present invention can be synthesized by using the thus-prepared methine moieties as starting materials according to the methods described in the following literature. A specific example of the synthesis of a methine compound of the present invention will be illustrated in Example 1 described hereinafter.

(a) F. M. Harmer, *Heterocyclic Compounds—Cyanine dyes and related compounds*, (John Wiley and Sons, New York London 1964).

(b) D. M. Sturmer, *Heterocyclic Compounds—Special topics in heterocyclic chemistry*, Chapter 8, Section 4, pp. 482–515 (John Wiley & Sons, New York London 1977).

Now, conventional crosslinked methine compounds will be illustrated below in comparison with the methine compounds of the present invention.

Methine compounds similar to those of general formulas (I) and (II) are disclosed in the following Literature Reference Sets (1) and (2). These compounds differ from the compounds of formulas (I) and (II) of the present invention in that the groups in the same locations as $R_3$, $R_5$ and $R_{5a}$ in formulas (I) and (II) are each a hydrogen atom or a halogen atom. Specific examples of methine compounds disclosed in Literature Reference Sets (I) and (2) include the following compounds:

(1)

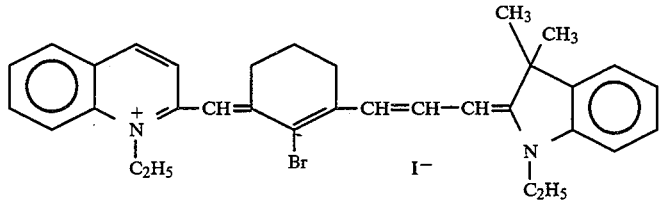

(2)

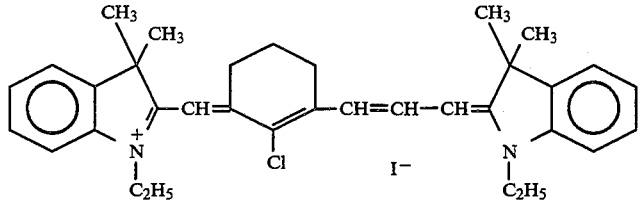

(3)

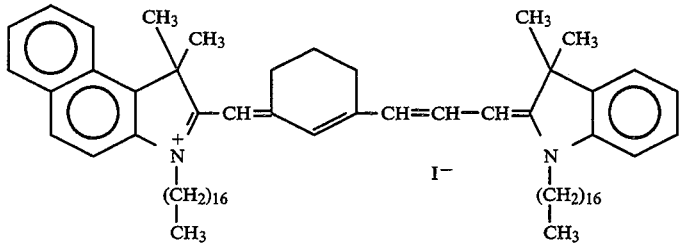

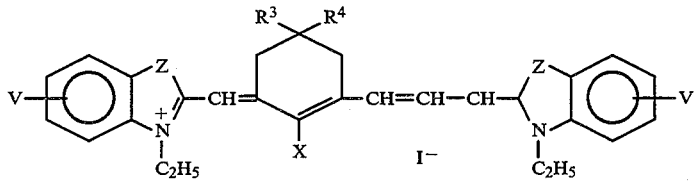

| Compound No. | $R_3$ | $R_4$ | X | Z | V |
|---|---|---|---|---|---|
| (4) | H | H | Cl | S | H |
| (5) | H | H | H | S | 5-$OCH_3$ |
| (6) | $C_2H_5$ | H | H | Se | 5-$OCH_3$ |
| (7) | $C_2H_5$ | H | H | Se | H |
| (8) | $C_2H_5$ | H | H | S | 5-$OCH_3$ |
| (9) | $C_2H_5$ | H | H | S | H |
| (10) | $CH_3$ | H | H | Se | 5-$OCH_3$ |
| (11) | $CH_3$ | H | H | Se | H |
| (12) | $CH_3$ | H | H | S | 5-$OCH_3$ |
| (13) | H | H | H | Se | 5-$OCH_3$ |
| (14) | H | H | H | Se | H |
| (15) | H | H | H | S | H |
| (16) | $CH_3$ | H | H | S | H |
| (17) | $CH_3$ | $CH_3$ | H | S | H |

-continued (18)

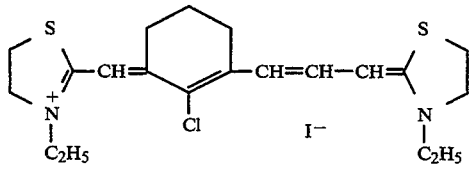

(19)

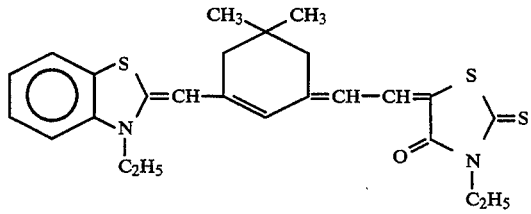

(20)

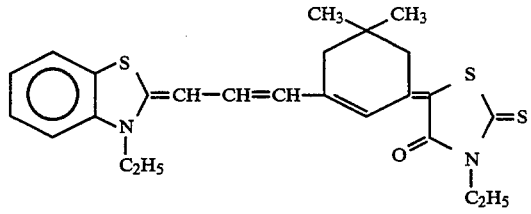

(21)

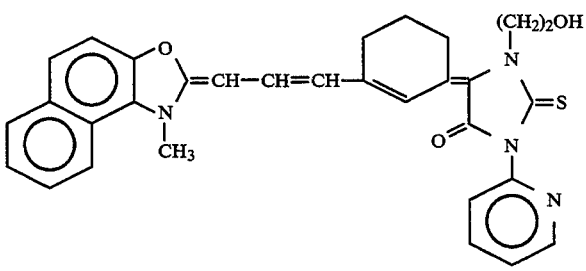

Literature Reference Set (1):

(a) F. M. Harmer, *Heterocyclic Compounds—Cyanine dyes and related compounds*, (John Wiley and Sons, New York London 1964).

(b) D. M. Sturmer, *Heterocyclic Compounds—Special topics in heterocyclic chemistry*, Chapter 8, Section 4, pp. 482–515 (John Wiley & Sons, New York London 1977).

(c) D. J. Fry, *Rodd's Chemistry of Carbon Compounds*, (2nd Ed. Vol. IV, part B, 1977) Chapter 15, pp. 369–422, and (2nd Ed. Vol. IV, part B, 1985) Chapter 15, pp. 267–296 (Elsvier Science Publishing Company Inc., New York).

Literature Reference Set (2):

(a) JP-A-63-247930

(b) DE 3,521,915

(c) JP-A-58-194595

(d) JP-A-59-67092

(e) JP-A-58-194595

(f) *IzV. Akad. Nauk SSSR. Ser. Fiz.*, Vol. 39, No. 11, pp. 2275–2279 (1975).

(g) *Kvantovaya Elektron* (Kiev), No. 6, pp. 48–71 (1982).

(h) *Hua-tung Hua Kung Hsueh Yuan Hsheh Pao*, No. 1, pp. 33–44 (1981).

To the present inventors' knowledge, the methine compounds of general formulas (I), (II) and (III) where $R_3$, $R_5$ and $R_{5a}$ each represents an alkyl group, an aryl group or a heterocyclic group according to the present invention have not as yet been disclosed in the literature.

The silver halide in the silver halide emulsions of the present invention may be any of silver bromide, silver iodobromide, silver iodochlorobromide, silver chlorobromide and silver chloride.

The silver halide grains used in the emulsions may have a regular crystal form such as cubic, tetradecahedral or octahedral, an irregular crystal form such as spherical or plate-like form or a composite form of these crystal forms. A mixture of grains having various crystal forms may be used.

As the grains having a plate-like form, tabular grains are preferred which have a grain size distribution such that grains having a thickness of not more than 0.5 μ, preferably not more than 0.3 μ, a grain size of preferably not less than 0.6 μ, and an average aspect ratio of not less than 5 account for at least 50% of the entire projected area of the grains.

The interior and surface layer of the silver halide grains may be different in phase from each other, or the silver halide grains may be composed of a uniform phase. The silver halide grains may be any of a surface latent image type wherein a latent image is predominantly formed on the surface of the grains (e.g., negative type emulsion) and an internal latent image type wherein a latent image is predominantly formed in the interior of the grains (e.g., internal latent image type emulsion).

A silver halide emulsion which can be preferably used in the present invention will be described in detail below.

It is preferred that the silver halide emulsions used in the present invention comprise silver chloride or silver chlorobromide containing substantially no silver iodide. The term "containing substantially no silver iodide" as used herein means that the content of silver iodide is not higher than 1 mol %, preferably not higher than 0.2 mol %. The emulsions may comprise grains having the same halogen composition or different halogen compositions. When emulsions comprising grains having the same halogen composition are used, the qualities of the grains can easily be made homogeneous. With regard to the halogen composition distributions of the interiors of the grains contained in the silver halide emulsions, suitable grain types can be selected by properly choosing from among uniform structure type grains wherein the halogen composition is uniform throughout the grain; integral layer structure type grains wherein the core of the silver halide grain has a different halogen composition than the shell (composed of a single layer or two or more layers) of the grain, said core being surrounded by the shell; and grains wherein the grain has a part having a different halogen composition in the interior of the grain or in a non-laminar form on the surface thereof. When the part having a different halogen composition is present on the surface of the grain, the grain has a structure such that the part having a different halogen composition is joined to the edge, corner or surface of the grain. When high sensitivity is to be obtained, the latter two types of grains are preferable to the former uniform structure type grains and are also preferred from the viewpoint of pressure resistance. When the silver halide grains have either of the latter two structures described above, the boundary between areas having different halogen compositions may be well-defined or not well-defined due to a mixed crystal formed by a difference in the halogen composition therebetween or may have such a structure that the halogen composition changes continuously.

High silver chloride emulsions having a high silver chloride content can be preferably used in light-sensitive materials for use in rapid processing. High silver chloride emulsions suitable for use in the present invention have a silver chloride content of preferably not less than 90 mol %, more preferably not less than 95 mol %.

It is preferred that the grains in the high silver chloride emulsions have a structure such that the grains have silver bromide-localized phases in a laminar or non-laminar form in the interiors of the grains and/or on the surfaces thereof. The localized phases have a halogen composition such that the silver bromide content thereof is preferably at least 10 mol %, more preferably higher than 20 mol %. These localized phases may exist in the interiors of the grains or at the edges, corners or planes thereof. In a preferred embodiment, the localized phases are formed on the corners of the grains by epitaxial growth.

Even when a high silver chloride emulsion having a silver chloride content of not lower than 90 mol % is used, the uniform structure type grains having a narrow halogen composition distribution are preferred because lowering of sensitivity can be inhibited as much as possible when pressure is applied to the light-sensitive materials. Increasing the silver chloride content of the silver halide emulsions is effective to reduce the replenishment rate of the developing solution. In cases where reducing the replenishing rate is important, emulsions having a silver chloride content of 98 to 100 mol %, that is, emulsions comprising nearly pure silver chloride, can be preferably used.

The silver halide grains contained in the silver halide emulsions used in the present invention have a mean grain size of preferably 0.1 to 2$\mu$. In this regard, the diameter of the grain is defined as the diameter of a circle having an area equal to the projected area of the grain, and the average of the diameters of the grains is referred to as the mean grain size.

A monodisperse system having a coefficient of variation in grain size distribution of not higher than 20%, preferably not higher than 15%, is preferred. The coefficient of variation is the value obtained by dividing the standard deviation of the grain size distribution by the mean grain size. It is preferred that a blend of monodisperse emulsions be added to the same layer, or that more than one monodisperse emulsion be coated by means of multi-layer coating to obtain a wide latitude.

The silver halide grains contained in the photographic emulsions may have a regular crystal form such as a cubic, tetradecahedral or octahedral form, an irregular crystal form such as a spherical or plate-like form, or a composite form of these crystal forms. A mixture of grains having various crystal forms may be used. In the present invention, it is preferred that the grains have a crystal form distribution such that at least 50%, preferably at least 70%, and more preferably at least 90% thereof are grains having regular crystal forms.

In addition to the above-described grains, tabular grain emulsions can be preferably used.

The term "tabular grain emulsion" as used herein refers to an emulsion wherein AgX grains having an aspect ratio of not lower than 3 account for at least 50% of the projected area of all the AgX grains in the emulsion. The aspect ratio is equal to the diameter of an AgX grain (defined as the diameter of a circle having an area equal to the projected area of the grain), divided by the thickness of the grain.

Emulsions wherein AgX grains having an aspect ratio of preferably not lower than 5, more preferably 5 to 8 account for at least 50%, preferably at least 70%, and particularly preferably at least 85% of the projected area of all the AgX grains are preferred.

Silver chlorobromide emulsions to be used in the present invention can be prepared by using the methods described in P. Glafkides, *Chimie et Phisique Photographique* (Paul Montel 1967), G. F. Duffin, *Photographic Emulsion Chemistry* (Focal Press 1966), and V. L. Zelikman et al., *Making and Coating Photographic Emulsions* (Focal Press 1964). Namely, any of the acid process, the neutral process and the ammonia process can be used. A soluble silver salt and a soluble halide can be reacted by the single jet process, the double jet process or a combination thereof. A reverse mixing method wherein grains are formed in the presence of an excess of silver ion can be used. There can also be used a controlled double jet process wherein the pAg in the liquid phase in which silver halide is formed is kept constant. According to this process, a silver halide emulsion wherein the crystal form of the grains is regular and the grain size is nearly uniform can be obtained.

Various polyvalent metal impurities can be introduced into the silver halide emulsions employed in the practice of the present invention during the course of the formation of the grains or the physical ripening of the emulsion. Examples of compounds of polyvalent metals which can be used in the introduction of the polyvalent metal impurities include salts of cadmium, zinc, lead, copper and thallium, and salts and complex salts of Group VIII elements such as iron, ruthenium, rhodium, palladium, osmium, iridium and platinum. Particularly, the Group VIII elements can be preferably used. The amounts of these compounds added will vary widely depending on the purpose, but the amounts are preferably $1\times10^{-9}$ to $1\times10^{-2}$ mol per mol of silver halide.

The silver halide emulsions of the present invention are usually chemical-sensitized and spectral-sensitized.

Chemical sensitization methods include sulfur sensitization as typified by the addition of unstable sulfur compounds, noble metal sensitization such as gold sensitization, and reduction sensitization. These sensitization methods may be used either alone or in combination. Compounds which can be preferably used in chemical sensitization are described in JP-A-62-215272 (right lower column of page 18 to right upper column of page 22).

Spectral sensitization may be carried out to spectral-sensitize the emulsions in each layer of the light-sensitive materials of the present invention, thus imparting spectral sensitization to a desired light wavelength region. It is preferred that spectral sensitizing dyes which absorb light in a wavelength region corresponding to the desired spectral sensitivity be used. Examples of spectral sensitizing dyes which can be used in the present invention include the methine compounds of the present invention and the compounds described in F. M. Harmer, *Heterocyclic compounds—Cyanine dyes and related compounds*, (John Wiley & Sons, New York, London 1964). Specific examples of compounds and spectral sensitization methods which can be preferably used in the present invention are described in the aforesaid JP-A-62-215272 (right upper column of page 22 to page 38).

The silver halide emulsions of the present invention may contain various compounds or precursors thereof to prevent the light-sensitive materials from being fogged during the preparation, storage or photographic processing thereof or to stabilize photographic performance. Specific examples of such compounds are described in the aforesaid JP-A-62-215272 (pages 39 to 72).

Surface latent image type emulsions wherein a latent image is predominantly formed on the surfaces of the grains may be used in the present invention.

When a semiconductor laser is used as a light source for digital exposure in the present invention, it is necessary that the infrared region be efficiently spectral-sensitized.

Sensitization by the M-band of the sensitizing dyes is used in infrared sensitization, and hence the spectral sensitivity distribution is generally broad in comparison with sensitization by the J-band. Accordingly, it is preferred that a colored layer containing a dye be provided on a colloid layer provided on the light-sensitive side of the support, which is farther from the support than the light-sensitive layer in question to thereby correct the spectral sensitivity distribution. This colored layer is effective in preventing color mixing by a filter effect.

The methine compounds of the present invention and other spectral sensitizing dyes can be incorporated in the silver halide emulsions by directly dispersing them in the emulsion or by dissolving them in a solvent such as water, methanol, ethanol, propanol, methyl cellosolve or 2,2,3,3-tetrafluoropropanol or a mixture thereof and adding the resulting solution to the emulsions. Further, they can be incorporated in the emulsions by dissolving them in water in the presence of an acid or a base and adding the resulting aqueous solution to the emulsions as described in JP-B-44-23389 (the term "JP-B" as used herein means an "examined Japanese patent publication"), JP-B-44-27555 and JP-B-57-22089, or by dissolving them in water in the presence of a surfactant and adding the resulting aqueous solution to the emulsions or by adding a colloid dispersion of the compounds to the emulsions as described in U.S. Pat. Nos. 3,822,135 and 4,006,025. They may be dissolved in a solvent which is substantially immiscible with water, such as phenoxyethanol, after which the resulting solution is dispersed in water or a hydrophilic colloid and then added to the emulsion. They may be directly dispersed in a hydrophilic colloid and the resulting dispersion may be added to the emulsion as described in JP-A-53-102733 and JP-A-58-105141.

The methine compounds and other spectral sensitizing dyes may be added at any stage during the course of the preparation of the emulsions, that is, before or during the formation of the grains, before the rinsing stage immediately after the formation of the grains, before or during chemical sensitization, before the solidification of the emulsions by cooling, immediately after chemical sensitization, or during the preparation of coating solutions. Generally, they are added after completion of chemical sensitization, but before coating. However, they may be added simultaneously with the addition of the chemical sensitizing agents to carry out spectral sensitization and chemical sensitization simultaneously as described in U.S. Pat. Nos. 3,628,969 and 4,225,666. Spectral sensitization may be carried out prior to chemical sensitization as described in JP-A-58-113928. The spectral sensitizing dyes can be added before completion of the formation of the precipitate of the silver halide grains to initiate spectral sensitization. Further, the spectral sensitizing dyes can be added in portions. Namely, a part thereof may be added prior to chemical sensitization, and the remainder thereof is then added after chemical sensitization as described in U.S. Pat. No. 4,225,666. The spectral sensitizing dyes may be added at any stage during the course of the formation of the silver halide grains as described in U.S. Pat. No. 4,183,755. Among the various stages, it is particularly preferred that the sensitizing dyes be added before the rinsing stage of the emulsions or before chemical sensitization.

The amounts of these spectral sensitizing dyes to be added will vary widely depending on conditions, but the amounts are usually in an amount of preferably $0.5\times10^{-6}$ to $1.0\times10^{-2}$ mol, more preferably $1.0\times10^{-6}$ to $5.0\times10^{-3}$ mol per mol of silver halide.

Supersensitization, which may be conducted by using compounds such as those described in JP-A-2-157749 (line 3 of right lower column of page 13 to the third line from the bottom of right lower column of page 22), is effective in carrying out M-band type sensitization in the red to infrared sensitization of the present invention.

The structure of the light-sensitive material of the present invention will be described below.

The light-sensitive material of the present invention comprises a support having thereon at least one silver halide emulsion layer, optionally having at least three silver halide emulsion layers. It is preferred that at least two of the three silver halide emulsion layers have spectral sensitivity maxima at 670 nm or above.

It is preferred that the light-sensitive layers contain at least one coupler which forms a color by a coupling reaction with an oxidation product of an aromatic amine compound. For full color hard copy, it is preferred that the light-sensitive material comprises a support having thereon at least three silver halide emulsion layers having different color sensitivities, the three layers containing a yellow color forming coupler, a magenta color forming coupler and a cyan color forming coupler, respectively, each of them forming a color by a coupling reaction with an oxidation product of an aromatic amine compound. These three different spectral sensitivities can properly be chosen according to the wavelength of the light source used for digital exposure. However, it is preferred that the nearest spectral sensitivity maxima be at least 30 nm away from each other from the viewpoint of color separation.

There is no particular limitation with regard to the relationship between the spectral sensitivity maxima and the color forming couplers (Y, M, C) to be contained in at least three light-sensitive layers (λ1, λ2, λ3) having different spectral sensitivity maxima. Namely, six kinds of combinations of $3\times2=6$ are possible. Further, there is no particular limitation with regard to the order of the coating of the at least three light-sensitive layers having different spectral sensitivity maxima from the side of the support. However, in some cases it is preferred from the viewpoint of rapid processing that the light-sensitive layer containing the silver halide grains having the greatest mean grain size and having the longest wavelength spectral sensitivity be the uppermost layer. Accordingly, there are 36 possible combinations of three different spectral sensitivities with three types of color couplers and the order of the layers. The present invention can be effectively applied to all of these 36 kinds of light-sensitive materials.

In the present invention, it is particularly preferred that a semiconductor laser be used as the light source for digital exposure. In this case, it is preferred that at least one of the three silver halide light-sensitive layers having different color sensitivities have a spectral sensitivity maximum at 730 nm or above, and further that at least two layers have spectral sensitivity maxima in the long wavelength region of at least 670 nm. Further, where a semiconductor laser is used as the light source, there is no particular limitation with regard to the relationship between the spectral sensitivity maxima and the color forming couplers and the order of the layers. Specific examples of light sources for digital exposure, spectral sensitivity maxima and color forming couplers include, but are not limited to, those shown in the following Table 1.

TABLE 1

| | Light source for digital exposure | | | Spectral sensitization maximum of light-sensitive material (nm) |
|---|---|---|---|---|
| | Light source | Wave-length (nm) | Color forming coupler | |
| 1 | AlGaInAs (670) | 670 | C | 670 |
| | GaAlAs (750) | 750 | Y | 730 |
| | GaAlAs (810) | 810 | M | 810 |
| 2 | AlGaInAs (670) | 670 | Y | 670 |
| | GaAlAs (750) | 750 | M | 730 |
| | GaAlAs (810) | 810 | C | 810 |
| 3 | AlGaInAs (670) | 670 | M | 670 |
| | GaAlAs (750) | 750 | C | 750 |

TABLE 1-continued

| | Light source for digital exposure | | | Spectral sensitization maximum of light-sensitive material (nm) |
|---|---|---|---|---|
| | Light source | Wave-length (nm) | Color forming coupler | |
| | GaAlAs (830) | 830 | Y | 830 |
| 4 | AlGaInAs (670) | 670 | Y | 670 |
| | GaAlAs (780) | 780 | M | 780 |
| | GaAlAs (830) | 830 | C | 840 |
| 5 | AlGaInAs (670) | 670 | C | 670 |
| | GaAlAs (780) | 780 | Y | 780 |
| | GaAlAs (880) | 880 | M | 880 |
| 6 | GaAlAs (780) | 780 | M | 780 |
| | GaAlAs (830) | 830 | C | 830 |
| | GaAlAs (880) | 880 | Y | 880 |
| 7 | GaAs (1200) + SHG[1]) | 600 | M | 600 |
| | AlGaInAs (670) | 670 | C | 670 |
| | GaAlAs (880) | 750 | Y | 750 |
| 8 | LED (580) | 580 | Y | 580 |
| | LED (670) | 670 | M | 670 |
| | LED (810) | 810 | C | 810 |

[1])SHG: Second higher frequency (or second harmonic) using non-linear optical element was used.

The photographic material of the present invention may be exposed as described below.

The light-sensitive material of the present invention may be subjected to a scanning system digital exposure wherein a photographic material having an image is exposed by moving relatively high-density light beams such as a laser beam or an LED to the light-sensitive materials. Accordingly, the time during which the silver halide in the light-sensitive material in this case is exposed is the time taken for exposing a certain micro-area. The minimum unit for controlling the amount of light from each digital data is generally used as the standard or reference micro-area which is called a pixel. Accordingly, exposure time per pixel is directly proportional to the size of the pixel. The size of the pixel varies depending on pixel density and, in practice, is in the range of 50 to 2,000 dpi. When the exposure time is defined as the time taken for exposing pixel size in the case where the pixel density is 400 dpi, the exposure time is preferably not longer than $10^{-4}$ seconds, more preferably not longer than $10^{-6}$ seconds.

It is preferred that the light-sensitive material of the present invention contains a dye decolorizable by processing (particularly oxonol dyes) as described in European Patent EP0,337,490A2 (pages 27 to 76) in such an amount as to give an optical reflection density of at least 0.70 at 680 nm to improve the sharpness of the image. Alternatively, it is preferred that the support for the photographic material of the present invention have a water-resistant layer which contains at least 12 wt % (more preferably at least 14 wt %) of a titanium oxide having a surface treated with a bivalent to tetravalent alcohol (e.g., trimethylol ethane). The use of the titanium oxide also tends to improve the sharpness of the image.

The light-sensitive material of the present invention may contain colloidal silver and dyes to prevent irradiation or halation, and particularly to ensure the separation of the spectral sensitivity distribution of each light-sensitive layer and safelight safety.

Examples of such dyes include oxonol dyes having a pyrazole nucleus, a barbituric nucleus or a barbituric acid nucleus as described in U.S. Pat. Nos. 506,385, 1,177.429, 1,131,884, 1,338,799, 1,385,371, 1,467,214, 1,433,102 and 1,553,516, JP-A-48-85130, JP-A-49-114420, JP-A-52-117132, JP-A-55-161233, JP-A-59-111640, JP-B-39-22069, JP-B-43-13168, U.S. Pat. Nos. 3,247,127, 3,469,985 and 4,078,933; oxonol dyes as described in U.S. Pat. Nos. 2,533,472 and 3,379,533, U.K. Patent 1,278,621, JP-A-1-134447 and JP-A-1-183652; azo dyes as described in U.K. Patents 575,691, 680,631, 599,623, 786,907, 907,125 and 1,045,609, U.S. Pat. No. 4,255,326 and JP-A-59-211043; azomethine dyes as described in JP-A-50-100116, JP-A-54-118247, U.K. Patents 2,014,598 and 750,031; arylidene dyes as described in U.S. Pat. Nos. 2,538,009, 2,688,541 and 2,538,008, U.K. Patents 584,609 and 1,210,252, JP-A-50-40625, JP-A-51-3623, JP-A-51-10927, JP-A-54-118247, JP-B-48-3286 and JP-B-59-37303; styryl dyes as described in JP-B-28-3082, JP-B-44-16594 and JP-B-59-28898; triarylmethane dyes as described in U.K. Patents 446,538 and 1,335,422 and JP-A-59-228250; merocyanine dyes as described in U.K. Patents 1,075,653, 1,153,341, 1,284,730, 1,475,228 and 1,542,807; and cyanine dyes as described in U.S. Pat. Nos. 2,843,486 and 3,294,539 and JP-A-1-291247.

Examples of methods for preventing these dyes from diffusing into adjacent layers include a method wherein a ballast group is introduced into the dye molecule to convert the dye into a nondiffusing dye; a method wherein a hydrophilic polymer having a charge opposite to the dissociated anionic dye is allowed to coexist with the dye as a mordant to localize the dye in a specific layer by the interaction between the polymer and the dye molecule, as described in U.S. Pat. Nos. 2,548,564, 4,124,386 and 3,625,694; a method wherein a specific layer is dyed by using a water-insoluble solid dye as described in JP-A-56-12639, JP-A-55-155350, JP-A55-155351, JP-A-63-27838, JP-A-63-197943 and European Patent 15,601; and a method wherein a specific layer is dyed by using fine metal salt particles having a dye adsorbed thereon as described in U.S. Pat. Nos. 2,719,088, 2,496,841 and 2,496,843 and JP-A-60-45237.

It is preferred that the light-sensitive material of the present invention contain a coupler in combination with a dye image storage improving compound as described in European Patent EP0,277,589A2. Particularly, the use in combination of a pyrazoloazole coupler and a dye image storage improving compound is preferred.

Namely, it is preferred from the viewpoints of (1) preventing stain from being formed by the developed dye formed by the reaction of a coupler with a color developing agent or an oxidation product thereof left behind in the layers during storage after processing, and (2) preventing other side effects from being caused, that a Compound (F) and/or a Compound (G) be used, the Compound (F) being capable of chemically bonding to any aromatic amine developing agent left behind after color development to form a compound which is chemically inert and substantially colorless, and the Compound (G) being capable of chemically bonding to any oxidation product of the aromatic amine color developing agent left behind after color development to form a compound which is chemically inert and substantially colorless.

It is also preferred that the light-sensitive material of the present invention contain an antifungal agent such as described in JP-A-63-271247 to prevent the image from deteriorating due to the growth of molds or bacteria in the hydrophilic colloid layers.

Supports which can-be preferably used for a light-sensitive material for display according to the present invention include a white polyester support and a support provided with a white pigment-containing layer on the silver halide emulsion layer side thereof. It is preferred that an antihalation layer be provided on the silver halide emulsion layer side of the support or the back side thereof to improve sharpness. It is particularly preferred that the transmission density of the support be set to 0.35 to 0.8 to thereby allow a display to be enjoyed by reflected light as well as transmitted light.

The exposed light-sensitive material can be subjected to conventional black-and-white or color development. In the case of color light-sensitive materials, it is preferred from the viewpoint of rapid processing that bleaching-fixing be carried out after color development. Particularly, when a high silver chloride emulsion is used, the pH of the bleaching-fixing solution is preferably not higher than about 6.5, more preferably not higher than about 6, to accelerate desilverization.

The silver halide emulsions, other materials (e.g., additives), photographic constituent layers (e.g., the arrangement of layers), methods for processing light-sensitive materials, and processing additives described in the following patent specifications, particularly European Patent Laid-Open EP0,355,660A2 (JP-A-2-139544) can be preferably applied to the light-sensitive material of the present invention.

| Photographic constituent, element, etc. | JP-A-62-215272 | JP-A-2-33144 | EP0,355,660A2 |
|---|---|---|---|
| Silver halide emulsion | Line 6 of right upper column of page 10 to line 5 of left lower column of page 12; and the 4th line from the bottom of right lower column of page 12 to line 17 of left upper column of page 13 | Line 16 of right upper column of page 28 to line 11 of right lower column of page 29; and line 2 to line 5 of page 30 | Line 53 of page 45 to line 3 of page 47; and line 20 to line 22 of page 47 |
| Solvents for silver halide | Line 6 to line 14 of left lower column of page 12; and the third line from the bottom of left upper column of page 13 to the bottom of left lower column of page 18 | — | — |
| Chemical sensitizing agent | The 3rd line from the bottom of left lower column to line 5 of | Line 12 to the bottom of right lower column of page 29 | Line 4 to line 9 of page 47 |

-continued

| Photographic constituent, element, etc. | JP-A-62-215272 | JP-A-2-33144 | EP0,355,660A2 |
|---|---|---|---|
| | right lower column of page 12; and line 1 of right lower column of page 18 to the 9th line from the bottom of right upper column of page 22 | | |
| Spectral sensitizing agent (spectral sensitization method) | The 8th line from the bottom of right upper column of page 22 to the bottom of page 38 | Line 1 to line 13 of left upper column of page 30 | Line 10 to line 15 of page 47 |
| Stabilizer for emulsion | Line 1 of left upper column of page 39 to the bottom of right upper column of page 72 | Line 14 of left upper column to line 1 of right upper column of page 30 | Line 16 to line 19 of page 47 |
| Development accelerator | Line 1 of left lower column of page 72 to line 3 of right upper column of page 91 | — | — |
| Color couplers (cyan, magenta and yellow couplers) | Line 4 of right upper column of page 91 to line 6 of left upper column of page 121 | Line 14 of right upper column of page 3 to the bottom of left upper column of page 18; and line 6 of right upper column of page 30 to line 11 of right lower column of page 35 | Line 15 to line 27 of page 4; line 30 of page 5 to the bottom of page 28; line 29 to line 31 of page 45; and line 23 of page 47 to line 50 of page 63 |
| Supersensitizing agent | Line 7 of left upper column of page 121 to line 1 of right upper column of page 125 | — | — |
| Ultraviolet light absorber | Line 2 of right upper column of page 125 to the bottom of left lower column of page 127 | Line 14 of right lower column of page 37 to line 11 of left upper column of page 38 | Line 22 to line 31 of page 65 |
| Color mixing inhibitor (image stabilizer) | Line 1 of right lower column of page 127 to line 8 of left lower column of page 137 | Line 12 of right upper column of page 36 to line 19 of left upper column of page 37 | Line 30 of page 4 to line 23 of page 5; line 1 of page 29 to line 25 of page 45; line 33 to line 40 of page 45; and line 2 to line 21 of page 65 |
| High-boiling and/or low-boiling organic solvent | Line 9 of left lower column of page 137 to the bottom of right upper column of page 144 | Line 14 of right lower column of page 35 to the 4th line from the bottom of left upper column of page 36 | Line 1 to line 51 of page 64 |
| Dispersion method of photographic additive | Line 1 of left lower column of page 144 to line 7 of right upper column of page 146 | Line 10 of right lower column of page 27 to the bottom of left upper column of page 28; and line 12 of right lower column of page 35 to line 7 of right upper column of page 36 | Line 51 of page 63 to line 56 of page 64 |
| Hardening agent | Line 8 of right upper column of page 146 to line 4 of left lower column of page 155 | — | — |
| Developing agent precursor | Line 5 of left lower column of page 155 to line 2 of right lower column of page 155 | — | — |
| Restrainer releasing compound | Line 3 to line 9 of right lower column of page 155 | — | — |
| Support | Line 19 of right lower column of page 155 to line 14 of left upper column of page 156 | Line 18 of right upper column of page 38 to line 3 of left upper column of page 39 | Line 29 of page 66 to line 13 of page 67 |
| Layer structure | Line 15 of left upper column of page 156 to line 14 of right lower column of page 156 | Line 1 to line 15 of right upper column of page 28 | Line 41 to line 52 of page 45 |
| Dye | Line 15 of right lower column of page 156 to the bottom of right lower column of page 184 | Line 12 of left upper column to line 7 of right upper column of page 38 | Line 18 to line 22 of page 66 |
| Color mixing inhibitor | Line 1 of left upper column of page 185 to line 3 of right lower column of page 188 | Line 8 to line 11 of right upper column of page 36 | Line 57 of page 64 to line 1 of page 65 |
| Gradation | Line 4 to line 8 of right | — | — |

-continued

| Photographic constituent, element, etc. | JP-A-62-215272 | JP-A-2-33144 | EP0,355,660A2 |
|---|---|---|---|
| controller | lower column of page 188 | | |
| Stain inhibitor | Line 9 of right lower column of page 188 to line 10 of right lower column of page 193 | The bottom of left upper column to line 13 of right lower column of page 37 | Line 32 of page 65 to line 17 of page 66 |
| Surfactant | Line 1 of left lower column of page 201 to the bottom of right upper column of page 210 | Line 1 of right upper column of page 18 to the bottom of right lower column of page 24; and the 10th line from the bottom of left lower column to line 9 of right lower column of page 27 | — |
| Fluorine-containing compound (antistatic agent, coating aid, lubricant, anti-sticking agent, etc.) | Line 1 of left lower column of page 210 to line 5 of left lower column of page 222 | Line 1 of left upper column of page 25 to line 9 of right lower column of page 27 | — |
| Binder (hydrophilic colloid) | Line 6 of left lower column of page 222 to the bottom of left upper column of page 225 | Line 8 to line 18 of right upper column of page 38 | Line 23 to line 28 of page 66 |
| Thickener | Line 1 of right upper column of page 225 to line 2 of right upper column of page 227 | — | — |
| Antistatic agent | Line 3 of right upper column of page 227 to line 1 of left upper column of page 230 | — | — |
| Polymer latex | Line 2 of left upper column of page 230 to the bottom of page 239 | — | — |
| Matting agent | Line 1 of left upper column of page 240 to the bottom of right upper column of page 240 | — | — |
| Photographic processing method (processing stage, additive, etc.) | Line 7 of right upper column of page 3 to line 5 of right upper column of page 10 | Line 4 of left upper column of page 39 to the bottom of left upper column of page 42 | Line 14 of page 67 to line 28 of page 69 |

Note:
The cited portions of JP-A-62-215272 include the amendment dated March 16, 1987 and attached to the end of the publication of JP-A-62-215272.
Futher, among the color couplers, short wave type yellow couplers as described in JP-A-63-231451, JP-A-63-123047, JP-A-63-241547, JP-A-1-173499, JP-A-1-213648 and JP-A-1-250944 can also be preferably used as the yellow couplers.

Examples of cyan couplers which can be preferably used in the present invention include, in addition to the diphenylimidazole couplers described in JP-A-2-33144, the 3-hydroxypyridine cyan couplers (particularly the two equivalent type coupler formed by introducing a chlorine-eliminable group into a four equivalent type coupler of Coupler (42), and Couplers (6) and (9)) as described in European Patent EP0,333,085A2; and cyclic active methylene cyan couplers (particularly, Couplers (3), (8) and (34)) as described in JP-A-64-332260).

The processing temperature of color developing solutions used in the present invention is 20° to 50° C., preferably 30° to 45° C. The processing time is preferably not substantially longer than 20 seconds. A low replenishing rate is preferred. However, the replenishment rate is usually 20 to 600 ml, preferably 50 to 300 ml, more preferably 60 to 200 ml, most preferably 60 to 150 ml per $m^2$ of the light-sensitive material.

It is preferred that the development time of the photographic material be not substantially longer than 20 seconds. The term "developemt time" as used herein refers to the time which is taken until the light-sensitive material is introduced into the subsequent bath after the light-sensitive material is introduced into the development bath and which includes the time taken for transferring the light-sensitive material from the development bath to the subsequent bath.

The pH of the rinsing stage or the stabilizing stage is preferably 4 to 10, more preferably 5 to 8. The temperature will vary depending on the use and characteristics of the light-sensitive material, but is generally 30° to 45° C., preferably 35° to 42° C. The time can be properly set across a wide range. However, a shorter time is preferred from the viewpoint of reducing the processing time. The time is preferably 10 to 45 seconds, more preferably 10 to 40 seconds. A smaller replenishment rate is preferred from the viewpoints of running costs, reduction of discharge, and handling.

Specifically, the preferred replenishment rate per the unit area of the light-sensitive material is 0.5 to 50 times, more preferably 2 to 15 times the amount carried over from the prebath, or not more than 300 ml, more preferably not more than 150 ml per $m^2$ of the light-sensitive material. Replenishment may be carried out continuously or intermittently.

The solution which has been used in the rinsing stage and/or the stabilizing stage can be introduced into the pre-stage to reuse it. For example, the overflow solution of rinsing water reduced by a multi-stage countercurrent system may be allowed to flow into the prebath, that is, the bleaching-fixing bath, and the bleaching-fixing bath is then replenished with a concentrated solution to thereby reduce the amount of waste liquor.

Drying methods which can be used for the photographic material of the present invention will be described below.

It is desirable that the drying time be as short as 20 to 40 seconds to obtain an image in cases where ultra-rapid processing is carried out. Means for shortening the drying time include a means for improving the drying of the light-sensitive material and a means for improving drying by driers. As a means for improving the drying of the light-sensitive material, the amount of hydrophilic binder such as gelatin may be reduced, whereby the amount of water absorbed into the layer can be reduced and drying can be expedited. From the viewpoint of reducing the amount of water carried over, water may be absorbed with squeeze rollers or cloth immediately after the light-sensitive material leaves the rinsing bath, whereby drying can be expedited. As a means for improving drying by driers, the temperature may be raised, or the flow drying air may be intensified, whereby drying can be expedited. Further, drying can be expedited by controlling the angle of the drying air to be blown against the light-sensitive material or by employing a means for removing discharged air.

The present invention will now be illustrated in greater detail by reference to the following examples which, however, are not to be construed as limiting the present invention in any way.

EXAMPLE 1

Synthesis of Compound (I-10)

Compound (I-10) was synthesized according to the following scheme.

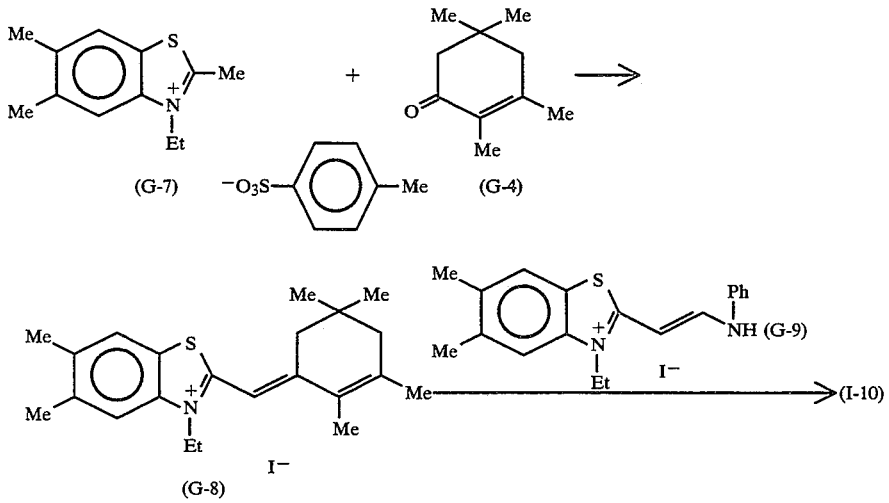

1.7 g of (G-7), 2.72 g of (G-4), 1.2 g of ammonium acetate, 4.4 ml of acetic acid and 44 ml of toluene were heated under reflux for 2 hours. The water formed was removed by using a Dean Stark tube. After the solvents were distilled off under reduced pressure, 1.4 g of sodium iodide in 100 ml of water and 100 ml of ethyl acetate were added to the residue and the mixture was stirred at room temperature. The precipitated crystals were collected by filtration by means of suction and dried to obtain 0.95 g (yield: 44%) of (G-8) as a brown powder.

0.85 g of (G-8), one ml of acetic anhydride and 4 ml of dimethylformamide were heated on a steam bath for 30 minutes. Further, 0.9 g of (G-9), 3 ml of dimethylformamide (DMF) and one ml of triethylamine were added thereto, and heating was continued for an additional 10 minutes. Subsequently, 10 ml of water and ethyl acetate were added to the reaction mixture, and the resulting mixture was stirred at room temperature.

The mixture was filtered by means of suction to recover the precipitated crystals. To the resulting crystals, there was added a mixture of 50 ml of methanol and 50 ml of chloroform to completely dissolve the crystals. The mixture was filtered by gravity. 30 ml of the filtrate was distilled off under reduced pressure. The precipitated crystals were collected by filtration by means of suction. This operation was repeated twice. 0.42 g (yield: 33%) of Compound (I-10) were obtained as purple crystals. Decomposition point: 278°-280° C. $\lambda$max(MeOH)=747 nm ($\epsilon=2.47\times10^5$).

EXAMPLE 2

Preparation of Emulsion A 3.3 g of sodium chloride were added to a 3% aqueous solution of lime-processed gelatin. Subsequently, 3.2 ml of N,N'-dimethylimidazolidine-2-thione (1% aqueous solution) were added thereto. To the resulting aqueous solution, there were added an aqueous solution containing 0.2 mol of silver nitrate and an aqueous solution containing 0.2 mol of sodium chloride and 15 $\mu$g of rhodium trichloride at 56° C. with vigorous stirring. Subsequently, an aqueous solution containing 0.780 mol of silver nitrate and an aqueous solution containing 0.780 mol of sodium chloride and 4.2 mg of potassium ferrocyanide were added thereto at 56° C. with vigorous stirring. Five minutes after completion of the addition of the aqueous solution of silver nitrate and the aqueous solution of the alkali metal halide, an aqueous solution containing 0.020 mol of silver nitrate and an aqueous solution containing 0.015 mol of potassium bromide, 0.005 mol of sodium chloride and 0.8 mg of potassium hexachloroiridate(IV) were added thereto at 40° C. with vigorous stirring. Subsequently, an isobutene/monosodium maleate copolymer was added thereto to carry out precipitation and rinsing, thus effecting desalting. Further, 90.0 g of lime-processed gelatin were added thereto, the pH of the resulting emulsion was adjusted to 6.2, and the pAg thereof was adjusted to 6.5. Further, $1\times10^{-5}$ mol of a sulfur sensitizing agent (triethylurea), $1\times10^{-5}$ mol of chloroauric acid and 0.2 g of nucleic acid were added to the emulsion, each amount being per mol of silver. Chemical sensitization was optimally carried out at 50° C.

The resulting silver chlorobromide Emulsion (A) was examined, and the form, grain size, and grain size distribution of the resulting grains were determined from electron micrographs. The silver halide grains had a cubic form. The grains had an average grain size of 0.52 μm and a coefficient of variation of 0.08. With regard to the grain size, the diameter of a grain was defined as the diameter of a circle having an area equal to the projected area of the grain, and the average of the diameters of the circles was defined as the mean grain size. The grain size distribution is a value obtained by dividing the standard deviation of the grain size by the mean grain size.

The halogen composition of the emulsion grains was determined by measuring the silver halide crystals by X-ray diffraction. Monochromatized CuK α-ray was used as a radiation source, and the angle of diffraction from the (200) face was fully measured. When the halogen composition comprises a uniform crystal, the diffraction pattern give a single peak, while the diffraction pattern of a crystal containing localized phases having different compositions from the host crystal gives a plurality of peaks corresponding to their respective compositions. The halogen compositions of the silver halide grains which constitute the crystal can be determined by calculating the lattice constant from the angle of diffraction of the peaks measured. The measurement of the silver chlorobromide Emulsion (A) showed that in addition to the main peak of 100% silver chloride, there was observed a broad diffraction pattern wherein the central part of a peak was 70% silver chloride (30% silver bromide) and the base of the curve was extended to an area in the vicinity of 60% silver chloride (40% silver bromide).

Preparation of Light-sensitive Material (a)

Both sides of a paper support were laminated with polyethylene. The surface of the paper support was subjected to a corona discharge treatment. A gelatin undercoat layer containing sodium dodecylbenzenesulfonate was provided on the support. Subsequently, the following photographic constituent layers were coated thereon to prepare a multi-layer color photographic paper. Coating solutions were prepared in the following manner.

Preparation of coating solution for first layer 19.1 g of Yellow Coupler (ExY), 4.4 g of Dye Image Stabilizer (Cpd-1) and 0.7 g of Dye Image Stabilizer (Cpd-7) were dissolved in 27.2 cc of ethyl acetate, 4.1 g of Solvent (Solv-3) and 4.1 g of Solvent (Solv-7). The resulting solution was emulsified and dispersed in 185 cc of a 10% aqueous solution of gelatin containing 8 cc of 10% sodium dodecylbenzenesulfonate to prepare an emulsified dispersion. Separately, the following red-sensitive Sensitizing Dye (Dye-1) was added to the silver chlorobromide Emulsion (A) to prepare an emulsion. The above emulsified dispersion and the resulting emulsion were mixed and dissolved. A coating solution for the first layer was prepared so as to give the following composition.

Coating solutions for the second layer through the seventh layer were prepared in the same manner as in the preparation of the coating solution for the first layer. A sodium salt of 1-oxy-3,5-dichloro-s-triazine was used as the hardening agent for gelatin in each layer.

(Cpd-10) and (Cpd-11) were added to each layer in such an amount as to give total amounts of 25.0 mg/m$^2$ and 50.0 mg/m$^2$ respectively. The following spectral sensitizing dyes were used in the layers indicated.

First layer (red-sensitive yellow color forming layer)
(Dye-1)

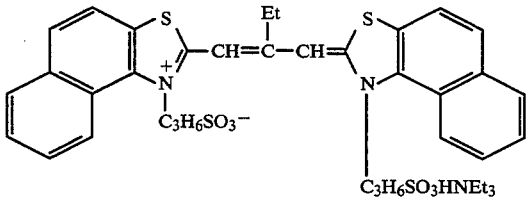

$1.0\times10^{-4}$ mol per mol silver halide

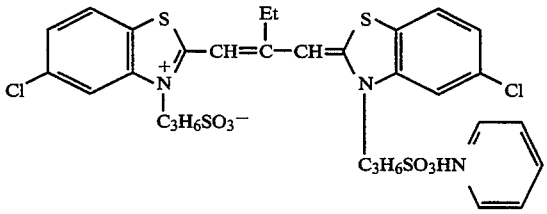

$1.0\times10^{-4}$ mol per mol silver halide

Third layer (infrared-sensitive magenta color forming layer)
(Dye-2)

-continued

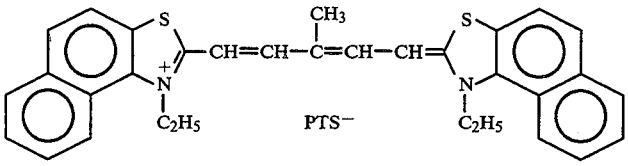

4.5 × $10^{-5}$ mol per mol silver halide

Fifth layer (infrared-sensitive cyan color forming layer)
(Dye-3)

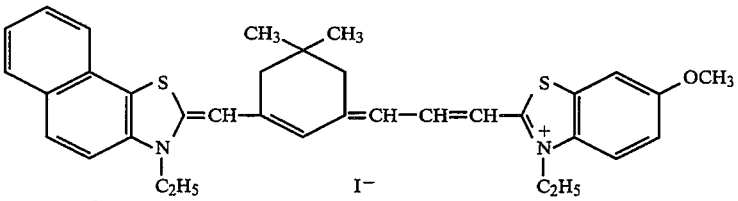

0.5 × $10^{-5}$ mol per mol silver halide

When (Dye-2) and (Dye-3) were used, $1.8\times10^{-3}$ mol of the following compound per mol of silver halide was added.

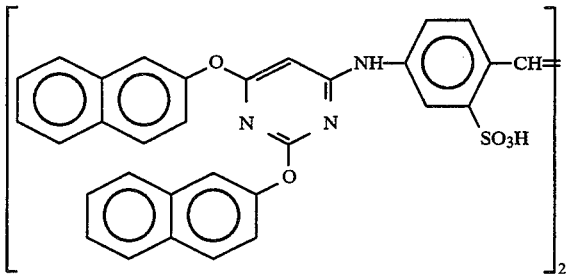

Further, $8.0\times10^{-4}$ mol of 1-(5-methylureidophenyl)-5-mercaptotetrazole per mol of silver halide was added to each of the yellow color forming emulsion layer, the magenta color forming emulsion layer and the cyan color forming emulsion layer.

The following dyes were added to the emulsion layers to prevent irradiation.

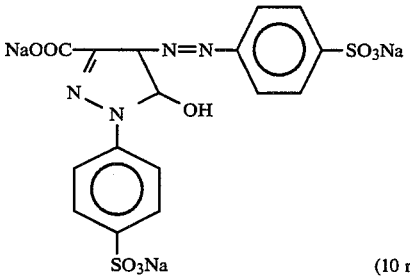

(10 mg/m²)

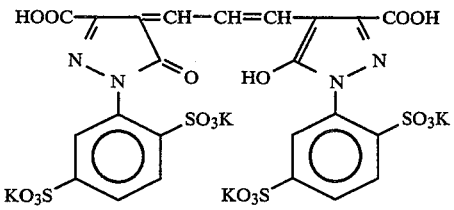

(10 mg/m²)

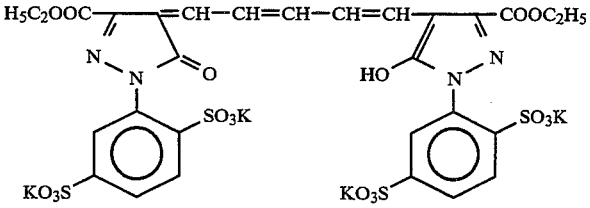

(40 mg/m²)

-continued

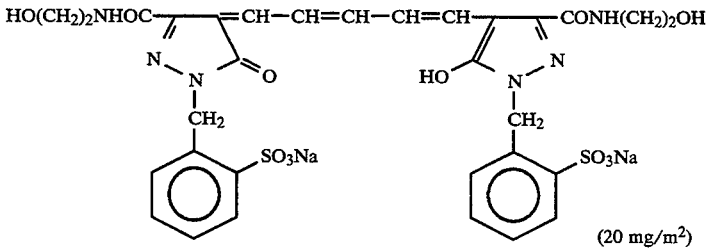

(20 mg/m²)

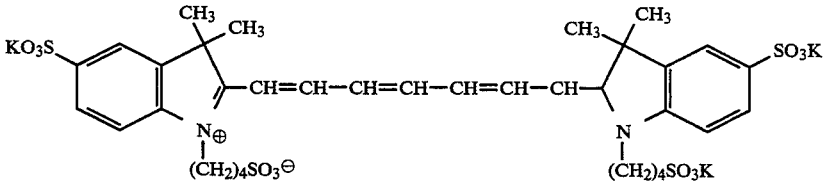

(10 mg/m²)

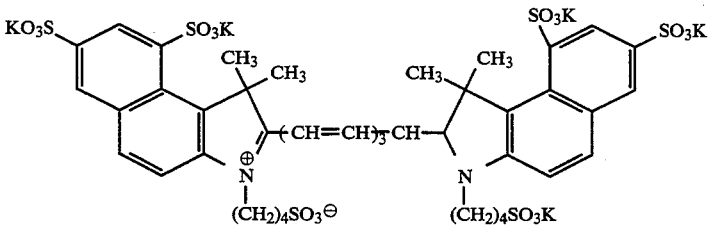

(5 mg/m²)

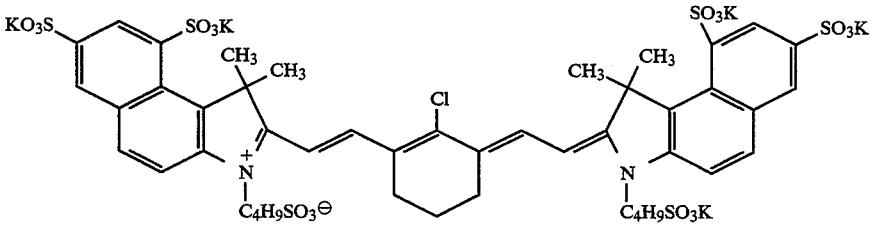

(5 mg/m²)

Layer structure

Each layer had the following composition. Numerals in the right-hand column represent coating weights (g/m²). The amounts of the silver halide emulsions are represented by coating weights in terms of silver.

Support

Polyethylene-laminated paper (Polyethylene on the first layer side contained white pigment ($TiO_2$) and bluish dye (ultra-marine))

| | |
|---|---|
| First layer (red-sensitive yellow color forming layer) | |
| The above silver chlorobromide Emulsion (A) | 0.30 |
| Gelatin | 1.86 |
| Yellow coupler (ExY) | 0.82 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| Second layer (color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third layer (infrared-sensitive magenta color forming layer) | |
| Silver chlorobromide Emulsion (A) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| Fourth layer (ultraviolet light absorbing layer) | |

-continued

| | |
|---|---|
| Gelatin | 1.58 |
| Ultraviolet light absorber (UV-1) | 0.47 |
| Color mixing inhibitor (Cpd-5) | 0.05 |
| Solvent (Solv-5) | 0.24 |
| Fifth layer (infrared-sensitive cyan color forming layer) | |
| Silver chlorobromide Emulsion (A) | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| Sixth layer (ultraviolet light absorbing layer) | |
| Gelatin | 0.53 |
| Ultraviolet light absorber (UV-1) | 0.16 |
| Color mixing inhibitor (Cpd-5) | 0.02 |
| Solvent (Solv-5) | 0.08 |
| Seventh layer (protective layer) | |
| Gelatin | 1.33 |
| Acrylic-modified copolymer of polyvinyl alcohol (degree of modification: 17%) | 0.17 |
| Liquid paraffin | 0.03 |

(ExY) Yellow Coupler

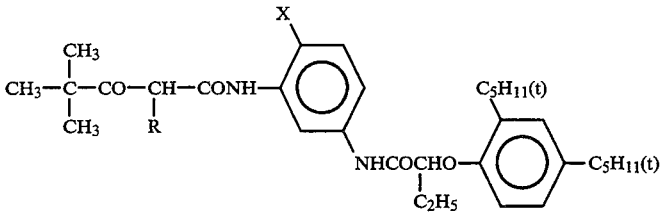

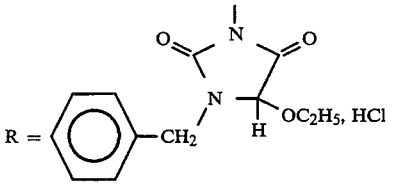

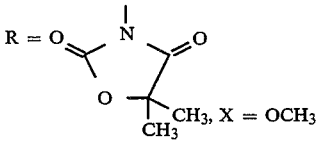

1:1 mixture by mol (ExM) Magenta Coupler

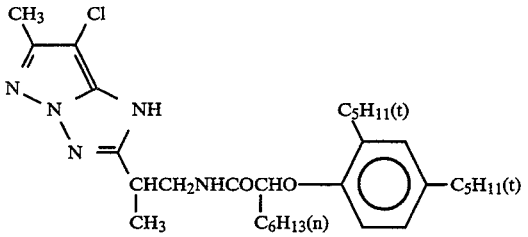

(ExC) Cyan Coupler

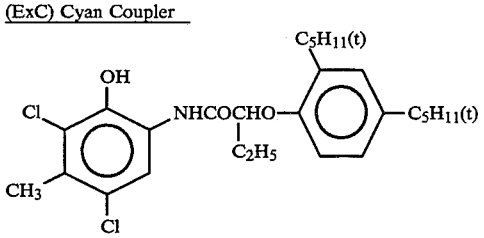

and

-continued
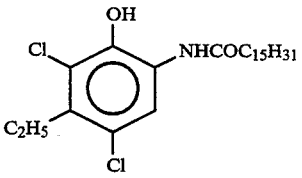
1:1 mixture (by mol)
(Cpd-1) Dye Image Stabilizer
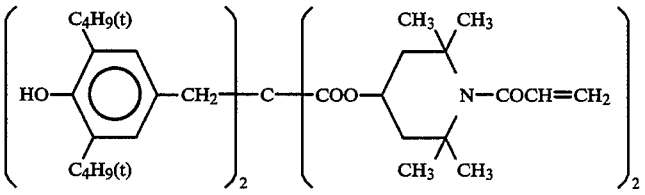
(Cpd-2) Dye Image Stabilizer
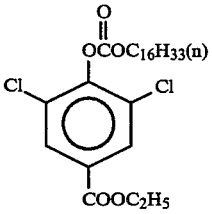
(Cpd-3) Dye Image Stabilizer
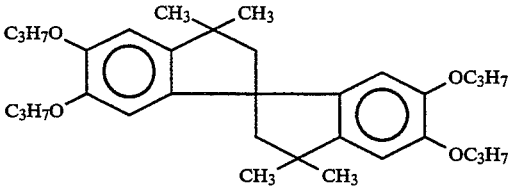
(Cpd-4) Dye Image Stabilizer
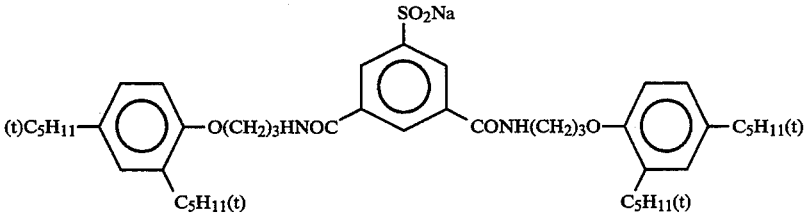
(Cpd-5) Color mixing inhibitor
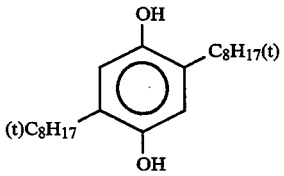
(Cpd-6) Dye Image Stabilizer
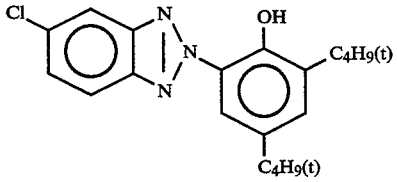

-continued
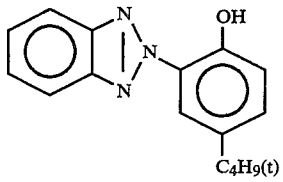
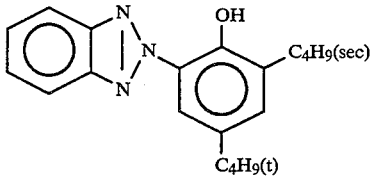
2:4:4 mixture (by weight)
(Cpd-7) Dye Image Stabilizer
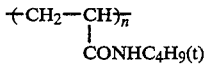
(Average MW 60,000)
(Cpd-8) Dye Image Stabilizer
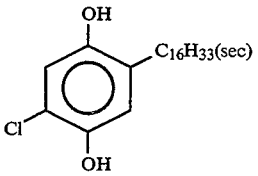
and
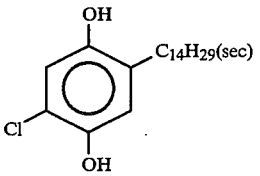
1:1 mixture (by weight)
(Cpd-9) Dye Image Stabilizer
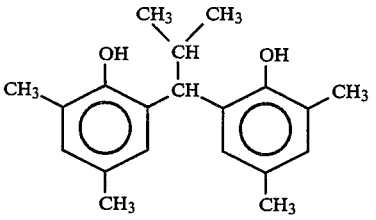
(Cpd-10) Antiseptic
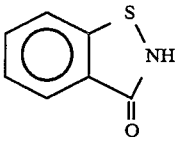
(Cpd-11) Antiseptic
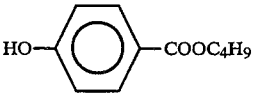
(UV-1) Ultraviolet light absorber
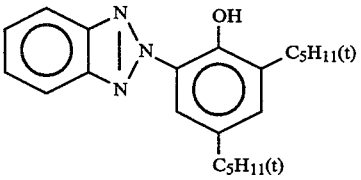

-continued
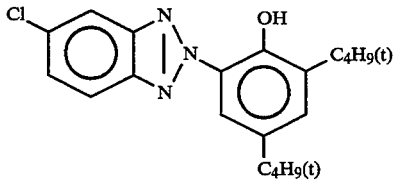
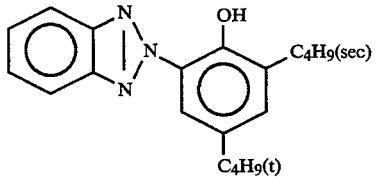
4:2:4 mixture (by weight)
(Solv-1) Solvent
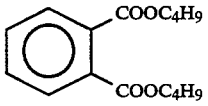
(Solv-2) Solvent
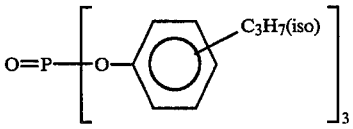
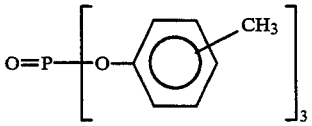
1:1 mixture (by volume)
(Solv-3) Solvent
$O{=}P{+}O{-}C_9H_{19}(iso)]_3$
(Solv-4) Solvent
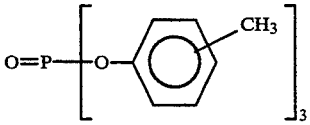
(Solv-5) Solvent
$COOC_8H_{17}$
|
$(CH_2)_3$
|
$COOC_8H_{17}$
(Solv-6) Solvent
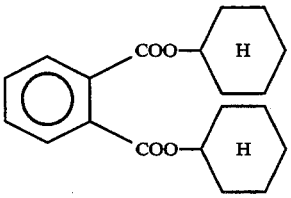

-continued $C_8H_{17}CHCH(CH_2)_7COOC_8H_{17}$
$\backslash\ /$
O

80:20 mixture (by volume)

(Solv-7) Solvent $C_8H_{17}CHCH(CH_2)_7COOC_8H_{17}$
$\backslash\ /$
O

Each of Samples 1 to 4 listed in Table 2 below was prepared in the same manner as Light-sensitive Material (a) except that the spectral sensitizing dye given in Table 2 was used in place of the spectral sensitizing dye used in the third layer (magenta color forming layer) of Light-sensitive Material (a). Further, each of Samples 5 to 12 listed in Table 2 was prepared in the same manner as Light-sensitive Material (a) except that the spectral sensitizing dye given in Table 2 was used in place of the spectral sensitizing dye used in the fifth layer (cyan color forming layer) of Light-sensitive Material (a). The following dyes were used as comparative sensitizing dyes.

C-1

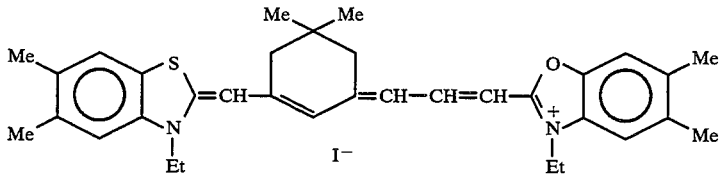

C-2

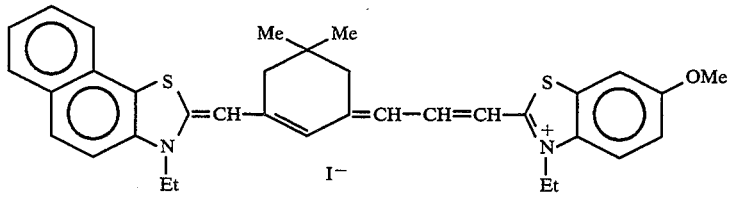

C-3

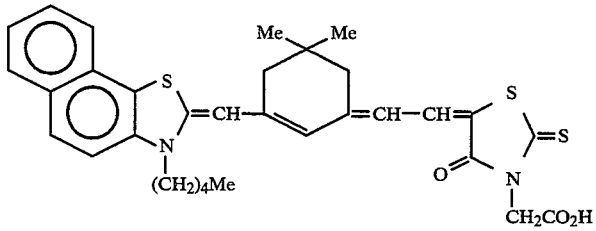

C-4

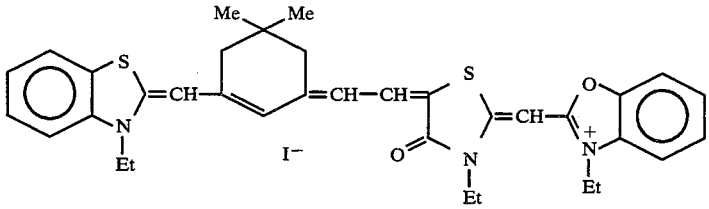

TABLE 2

| Sample No. | Compound and amount added $\times 10^{-5}$ mol/mol of Ag | | Stored at −30° C. in a sealed bag purged with argon gas: Relative sensitivity | Fog | Stored at 80% RH, 50° C. for 3 days: Relative sensitivity | Fog | Stored under oxygen partial pressure of 10 atm for 7 days: Relative sensitivity | |
|---|---|---|---|---|---|---|---|---|
| 1 | C-1 | 1.1 | 100 (standard) | 0.03 | 85 | 0.05 | 81 | Comparison |
| 2 | I-10 | 1.1 | 110 | 0.03 | 96 | 0.05 | 93 | Invention |
| 3 | (19) | 1.1 | 102 | 0.03 | 72 | 0.04 | 65 | Comparison |
| 4 | II-1 | 1.1 | 107 | 0.03 | 93 | 0.04 | 91 | Invention |
| 5 | (17) | 1.1 | 100 (standard) | 0.04 | 72 | 0.04 | 64 | Comparison |
| 6 | I-1 | 1.1 | 117 | 0.04 | 91 | 0.04 | 91 | Invention |

TABLE 2-continued

| Sample No. | Compound and amount added | $\times 10^{-5}$ mol/mol of Ag | Stored at −30° C. in a sealed bag purged with argon gas: Relative sensitivity | Fog | Stored at 80% RH, 50° C. for 3 days: Relative sensitivity | Fog | Stored under oxygen partial pressure of 10 atm for 7 days: Relative sensitivity | |
|---|---|---|---|---|---|---|---|---|
| 7 | C-2 | 1.1 | 105 | 0.04 | 74 | 0.05 | 66 | Comparison |
| 8 | I-2 | 1.1 | 120 | 0.04 | 89 | 0.04 | 87 | Invention |
| 9 | C-3 | 1.0 | 105 | 0.03 | 72 | 0.04 | 57 | Comparison |
| 10 | II-2 | 1.0 | 115 | 0.03 | 93 | 0.03 | 85 | Invention |
| 11 | C-4 | 1.0 | 103 | 0.03 | 65 | 0.03 | 58 | Comparison |
| 12 | III-1 | 1.0 | 112 | 0.03 | 92 | 0.03 | 91 | Invention |

Each of the coated samples was divided into three groups. One group was hermetically sealed in an oxygen-impermeable bag purged with argon and stored at a temperature of −30° C. Another group was stored at 80% RH and 50° C. for 3 days. Still another group was stored at room temperature under an oxygen partial pressure of 10 atm for 7 days.

The thus-obtained light-sensitive materials were exposed to light by using the following two types of exposure devices:

(1) A sensitometer (FWH type, color temperature of light source: 3200° K., manufactured by Fuji Photo Film Co., Ltd.) was used. The samples were subjected to gradation exposure for sensitometry through metallized interference filters of 670 nm, 750 nm and 830 nm for 10 seconds.

(2) A device containing AlGaInP semiconductor laser (oscillating wavelength: about 670 nm), a GaAlAs semiconductor laser (oscillating wavelength: about 750 nm) and a GaAlAs semiconductor laser (oscillating wavelength: about 830 nm) was used. The device used was designed so that color photographic papers which were transferred in the direction perpendicular to the scanning direction were successively subjected to scanning exposure to laser beams by a rotary polyhedron. Using this device, the amount of light was changed, and the relationship D-logE between the density (D) of the light-sensitive material and the amount of light (E) was determined. The exposure amount to the semiconductor laser beams was controlled by combining a pulse width modulation system wherein the amount of light was modulated by changing the time electricity was applied to the semiconductor laser with an intensity modulation system wherein the amount of light was modulated by changing the amount of electricity. This scanning exposure was carried out by using 400 dpi, and the average exposure time per pixel was about $10^{-7}$ seconds.

After exposure, processing was carried out in the following manner.

Processing

The exposed samples were subjected to continuous processing (running test) in the following processing stages by using a paper processor until the amount of replenisher was twice the tank capacity of the color developing solution.

| Processing Stage | Temperature (°C.) | Time (sec) | Replenishment Rate* (ml) | Tank Capacity (l) |
|---|---|---|---|---|
| Color Development | 35 | 45 | 161 | 17 |
| Bleaching-fixing | 30–35 | 45 | 215 | 17 |
| Rinse (1) | 30–35 | 20 | — | 10 |
| Rinse (2) | 30–35 | 20 | — | 10 |
| Rinse (3) | 30–35 | 20 | 350 | 10 |

-continued

| Processing Stage | Temperature (°C.) | Time (sec) | Replenishment Rate* (ml) | Tank Capacity (l) |
|---|---|---|---|---|
| Drying | 70–80 | 60 | | |

*Replenishment rate being per $m^2$ of the light-sensitive material. A three tank countercurrent system flowing from Rinse (3) to (1) was used.

Each processing solution had the following composition.

Color developing solution

| | Tank Solution | Replenisher |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 4.0 g | 5.0 g |
| Monodsodium salt of N,N-di-(sulfoethyl)hydroxylamine | 4.0 g | 5.0 g |
| Fluorescent brightener (WHITEX 4B manufactured by Sumitomo Chemical Co., Ltd.) | 1.0 g | 1.0 g |
| Water to make | 1000 ml | 1000 ml |
| pH (25° C.) | 10.05 | 10.45 |

Bleaching-fixing solution
Tank solution and replenisher being the same.

| | |
|---|---|
| Water | 400 ml |
| Ammonium thiosulfate (700 g/l) | 100 ml |
| Sodium sulfite | 17 g |
| Ammonium ethylenediaminetetraacetato ferrate | 55 g |
| Disodium ethylenediaminetetraacetate | 5 g |
| Ammonium bromide | 40 g |
| Water to make | 1000 ml |
| pH (25° C.) | 6.0 |

Rinsing solution

Tank solution and replenisher being the same.

Ion-exchanged water (each of the concentrations of calcium ion and magnesium ion being reduced to not higher than 3 ppm).

The results are shown in Table 2. The sensitivity obtained by using the sensitometer is shown. Similar results were obtained when a semiconductor laser was used. The reciprocal of the exposure amount giving a density of (cyan density of 0.5+Fog) is defined as the sensitivity.

With regard to Samples 1 to 4 stored at −30° C. in a sealed bag purged with argon gas, the sensitivity is given in terms of the relative sensitivity when the sensitivity of Sample 1 is taken as 100. With regard to Samples 5 to 12, the sensitivity is given in terms of the relative sensitivity when the sensitivity of Sample 5 is taken as 100.

With regard to the samples stored at 85% RH and 50° C. and the samples stored under an oxygen partial pressure of 10 atm, the sensitivity is given in terms of the relative sensitivity when the sensitivity of each corresponding sample stored at −30° C. in the argon gas atmosphere is taken as 100.

EXAMPLE 3

The light-sensitive materials of Example 2 were tested in the same manner as in Example 2 except that the light-sensitive materials were subjected to the following Processing (II) by using the aforesaid automatic processor. Results similar to those of Example 2 were obtained.

Processing of the light-sensitive materials: Processing (II)

The light-sensitive materials were subjected to the following Processing (II) by using the aforesaid automatic processor.

| Processing stage | Processing (II) | |
|---|---|---|
| Color development | 38° C. | 20 sec |
| Bleaching-fixing | 38° C. | 20 sec |
| Rinse (1) | 38° C. | 7 sec |
| Rinse (2) | 38° C. | 7 sec |
| Rinse (3) | 38° C. | 7 sec |
| Rinse (4) | 38° C. | 7 sec |
| Rinse (5) | 38° C. | 7 sec |
| Drying | 65° C. | 15 sec |

(A five tank countercurrent system flowing from (5) to (1) was used.)

Each processing time of the above stages is the time which was taken until the light-sensitive material was introduced into the subsequent processing solution after it was introduced into a processing solution to process it and which includes the time taken for conveying the light-sensitive material in the air to transfer it from a processing solution to the subsequent processing solution. The precentage of the processing time during which the photographic material is being conveyed from one stage to the next in the air usually varies depending on the size of the processor, but is in the range of 5 to 40% in the practice of the present invention.

Each processing solution had the following composition.

| Color developing solution | Tank Solution | Replenisher |
|---|---|---|
| Water | 700 ml | 700 ml |
| Sodium triisopropyl-naphthalene-(β)sulfonate | 0.1 g | 0.1 g |
| Ethylenediaminetetraacetic acid | 3.0 g | 3.0 g |
| Disodium salt of 1,2-dihydroxybenzene-4,6-disulfonic acid | 0.5 g | 0.5 g |
| Triethanolamine | 12.0 g | 12.0 g |
| Potassium chloride | 6.5 g | — |
| Potassium bromide | 0.03 g | — |
| Sodium sulfite | 0.1 g | 0.1 g |
| Potassium carbonate | 27.0 g | 27.0 g |
| 4-Amino-N-ethyl-N-(3-hydroxypropyl)-3-methylaniline | 12.8 g | 27.8 g |
| Disodium N,N-bis(sulfonatoethyl)hydroxylamine | 10.0 g | 13.0 g |
| Fluorescent brightener | 2.0 g | 6.0 g |

-continued

| Color developing solution | Tank Solution | Replenisher |
|---|---|---|
| (UVITEX-CK manufactured by Ciba-Geigy) | | |
| Water to make | 1000 ml | 1000 ml |
| pH (25° C.) | 10.05 | 10.95 |

The replenishment rate of the above replenisher was 35 ml per $m^2$ of the light-sensitive material.

| Bleaching-fixing solution | Tank Solution | Replenisher |
|---|---|---|
| Water | 400 ml | 400 ml |
| Ammonium thiosulfate (700 g/l) | 100 ml | 250 ml |
| Ethylenediaminetetraacetic acid | 3.4 g | 8.5 g |
| Ammonium ethylenediaminetetraacetato ferrate dihydrate | 73.0 g | 183 g |
| Ammonium sulfite | 40 g | 100 g |
| Ammonium bromide | 20.0 g | 50.0 g |
| Nitric acid (67%) | 9.6 g | 24 g |
| Water to make | 1000 ml | 1000 ml |
| pH (25° C.) | 5.80 | 5.10 |

The replenishment rate of the above replenisher was 35 ml per $m^2$ of the light-sensitive material.

Rinsing solution

Tank solution and replenisher were the same.

Ion-exchanged water was used, and the replenishment rate thereof was 60 ml/$m^2$.

EXAMPLE 4

The light-sensitive materials of Example 2 were tested in the same manner as in Example 2 except that the light-sensitive materials were subjected to the following Processing (III) by using the aforesaid automatic processor. Results similar to those of Example 2 were obtained.

| Processing stage | Processing (III): | | Replenishment rate per $m^2$ of the light-sensitive material |
|---|---|---|---|
| Color development | 38.5° C. | 45 sec | 35 ml |
| Bleaching-fixing | 38° C. | 20 sec | 35 ml |
| Rinse (1) | 38° C. | 12 sec | |
| Rinse (2) | 38° C. | 12 sec | |
| Rinse (3) | 38° C. | 12 sec | 105 ml |
| Drying | 65° C. | 15 sec | |

(A three tank countercurrent system flowing from (3) to (1) was used.)

The processing solution of the above Processing (III) had the following composition.

| Color developing solution | Tank Solution | Replenisher |
|---|---|---|
| Water | 700 ml | 700 ml |
| Sodium triisopropyl-naphthalene-(β)sulfonate | 0.1 g | 0.1 g |
| Ethylenediaminetetraacetic acid | 3.0 g | 3.0 g |
| Disodium salt of 1,2-dihydoxybenzene-4,6-disulfonic acid | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |

-continued

| Color developing solution | Tank Solution | Replenisher |
|---|---|---|
| Sodium sulfite | 0.1 g | 0.1 g |
| Disodium N,N-bis(sulfonato-ethyl)hydroxylamine | 10.0 g | 13.0 g |
| N-ethyl-N-(β-methanesulfon-amidoethyl)-3-methyl-4-amino-aniline sulfate | 5.0 g | 11.5 g |
| Fluorescent brightener (UVITEX-CK manufactured by Ciba-Geigy) | 2.0 g | 6.5 g |
| Water to make | 1000 ml | 1000 ml |
| pH (25° C.) | 10.05 | 10.05 |

The bleach-fixing solution and the rinsing solution were the same as those used in Example 1. Other conditions were the same as those used in Example 1.

EXAMPLE 5

Each of the compounds indicated in Table 3 was added to a gold-sulfur-sensitized tabular silver iodobromide emulsion (mean grain size: 0.82 μm, average ratio of grain size/thickness: 11.2, pAg: 8.2, pH: 6.5) prepared according to the method described in Example 1 of JP-A-60-131533 at 40° C. A sodium salt of 2,4-dichloro-6-hydroxy-1,3,5-triazine as a hardening agent for gelatin was added thereto. The resulting emulsion was coated on a cellulose triacetate support. A protective layer mainly comprising gelatin and containing a surfactant and the aforesaid hardening agent for gelatin was simultaneously coated on the emulsion layer.

Each of the thus-prepared samples was divided into three groups. One group was stored at a temperature of −30° C. for one year. Another group was stored under natural environmental conditions for one year. Still another group was stored at a temperature of −30° C. and then stored at 80% RH and 50° C., 3 days before exposure. These three groups of samples were subjected to exposure for sensitometry through a sharp cut filter which transmitted light having a wavelength longer than 520 nm by using a sensitometer (provided with an ultraviolet light absorbing filter device and a tungsten light source, color temperature: 2854° K., FWH sensitometer manufactured by Fuji Photo Film Co., Ltd.). The exposed samples were developed with a developing solution described hereinafter, bleached, rinsed and then dried.

The fog density and sensitivity of each sample processed were determined using a densitometer manufactured by Fuji Photo Film Co., Ltd. The reciprocal of the exposure amount giving a density of (0.2+fog density) was defined as the sensitivity. With regard to the samples stored at −30° C. the sensitivity is shown in Table 3 in terms of the relative sensitivity when the sensitivity of Sample 1 is taken as 100. With regard to the samples stored at 80% RH and 50° C. and the samples stored under natural environmental conditions, the sensitivity is shown in terms of the relative sensitivity when the sensitivity of each corresponding sample stored at −30° C. is taken as 100.

| Composition of developing solution | |
|---|---|
| Metol | 2.5 g |
| L-Ascorbic acid | 10.0 g |
| Potassium bromide | 1.0 g |
| Nabox | 35.0 g |
| Water to make | 1.0 liter |
| | pH = 9.8 |

It is apparent from Table 3 that the methine compounds of the present invention have high sensitivity and scarcely cause a lowering in sensitivity or desensitization with the passage of time.

TABLE 3

| Sample No. | Polymethine compound and amount added $\times 10^{-5}$ mol/mol of Ag | Stored at −30° C. Sensitivity | Stored at −30° C. Fog | Stored at 80% RH, 50° C. for 3 days Relative sensitivity | Stored at 80% RH, 50° C. for 3 days Fog | Stored under natural conditions for one year Relative sensitivity | Stored under natural conditions for one year Fog | |
|---|---|---|---|---|---|---|---|---|
| 1 | (16) 70 | 100 (standard) | 0.02 | 81 | 0.02 | 79 | 0.02 | Comparison |
| 2 | I-17 70 | 117 | 0.02 | 96 | 0.02 | 93 | 0.02 | Invention |
| 3 | (20) 1.0 | 102 | 0.02 | 78 | 0.04 | 76 | 0.03 | Comparison |
| 4 | II-9 1.0 | 112 | 0.02 | 89 | 0.03 | 87 | 0.02 | Invention |
| 5 | C-5 1.0 | 96 | 0.02 | 76 | 0.02 | 74 | 0.02 | Comparison |
| 6 | III-2 1.0 | 107 | 0.02 | 89 | 0.02 | 85 | 0.02 | Invention |

C-5

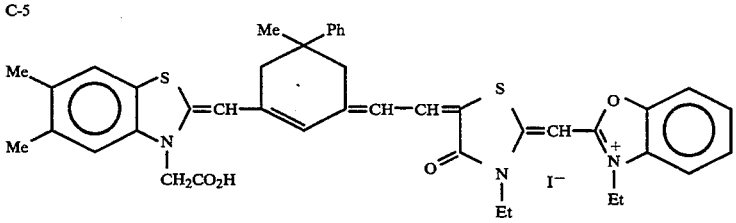

EXAMPLE 6

A cubic silver bromide emulsion was prepared according to the method described in Example 1 of JP-A-1-223441. The resulting silver bromide grains in the silver bromide emulsion were monodisperse grains having an average side length of 0.74 μm (coefficient of variation: 10.6%). The pH of the emulsion was adjusted to 6.3 at 40° C., and the pAg thereof was adjusted to 8.4. Chloroauric acid and sodium thiosulfate were added to the emulsion, and the emulsion was ripened at 55° C. to carry out optimal gold-sulfur sensitization.

Each of the compounds indicated in Table 4 was added to the emulsion at 40° C. Further, 0.1 g of a sodium salt of 2-hydroxy-4,6-dichloro-1,3,5-triazine and 0.1 g of sodium dodecylbenzenesulfonate were added to the emulsion, each amount being per one kg of the emulsion. The resulting emulsion was coated on a polyethylene terephthalate film base. A protective layer was provided thereon in the same manner as in Example 5.

Each of the thus-prepared coated samples was divided into three groups. One group was stored at a temperature of −30° C. for 3 days. Another group was stored at 80% RH and 50° C. for 3 days. Still another group was stored at room temperature under an oxygen partial pressure of 10 atm for 3 days. In the same manner as in Example 5, these samples were then subjected to exposure for sensitometry and processed. The sensitivity of each sample was then measured. The reciprocal of the exposure amount giving a density of (0.2+fog density) was defined as the sensitivity. The results are shown in Table 4. With regard to the samples stored at −30° C., the sensitivity is shown in Table 4 in terms of the relative sensitivity when the sensitivity of Sample 1 is taken as 100. With regard to the samples stored at 80% RH and 50° C. and the samples stored under an oxygen partial pressure of 10 atm, the sensitivity is shown in terms of the relative sensitivity when the sensitivity of each corresponding sample stored at −30° C. is taken as 100.

TABLE 4

| Sample No. | Compound and amount added ($\times 10^{-4}$ mol/mol of Ag) | Relative sensitivity: Stored at −30° C. | Relative sensitivity: Stored at 80% RH, 50° C. for 3 days | Relative sensitivity: Stored under oxygen partial pressure of 10 atm | |
|---|---|---|---|---|---|
| 1 | C-6 0.45 | 100 (standard) | 74 | 72 | Comparison |
| 2 | I-12 0.45 | 117 | 89 | 87 | Invention |
| 3 | I-12 0.45 (V-1) 3.0 | 135 | 96 | 93 | Invention |
| 4 | C-7 0.05 | 102 | 67 | 58 | Comparison |
| 5 | C-7 0.05 (V-2) 3.0 | 105 | 69 | 60 | Comparison |
| 6 | II-4 0.05 | 115 | 89 | 85 | Invention |
| 7 | II-4 0.05 (V-2) 3.0 | 135 | 96 | 93 | Invention |
| 8 | C-8 0.07 | 98 | 62 | 59 | Comparison |
| 9 | C-8 0.07 (IV-1) 3.4 | 100 | 66 | 63 | Comparison |
| 10 | I-5 0.07 | 120 | 85 | 83 | Invention |

TABLE 4-continued

| Sample No. | Compound and amount added ($\times 10^{-4}$ mol/mol of Ag) | Relative sensitivity: Stored at −30° C. | Relative sensitivity: Stored at 80% RH, 50° C. for 3 days | Relative sensitivity: Stored under oxygen partial pressure of 10 atm | |
|---|---|---|---|---|---|
| 11 | I-5 0.07 (IV-1) 3.4 | 145 | 96 | 93 | Invention |

C-6

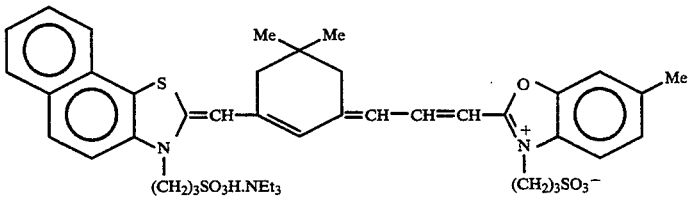

C-7

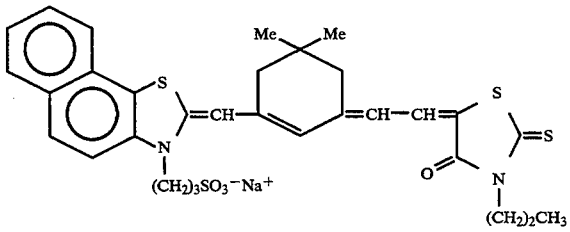

C-8

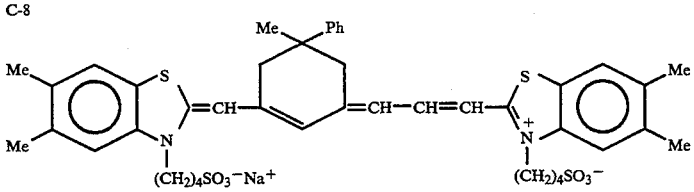

V-1

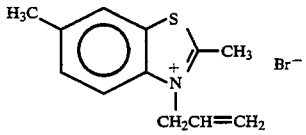

V-2

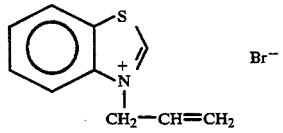

IV-1

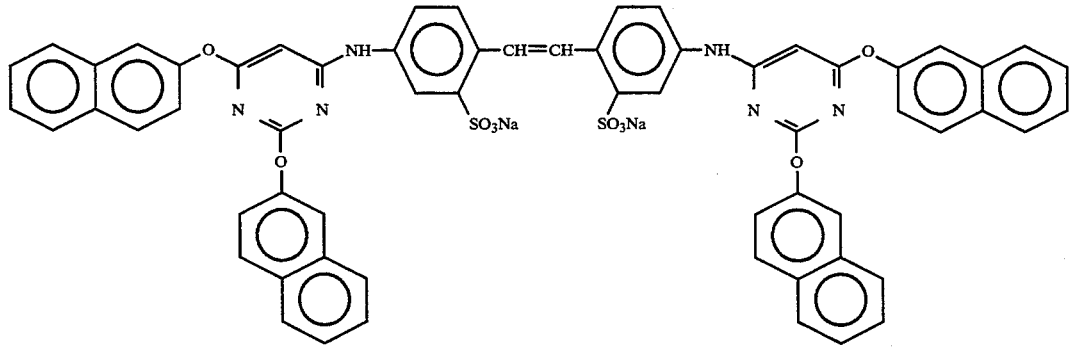

V-3

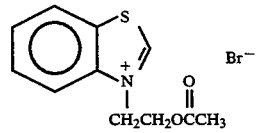

Table 4 shows that the methine compounds of the present invention have high sensitivity and scarcely cause a lowering in sensitivity even under the above storage conditions. Further, when a polymethine compound of the invention is used in combination with Compound (V-1) or (V-2) as in Samples 3 and 7, the sensitivity can be further increased and the degree of the lowering in sensitivity can be further reduced. Sample 11 wherein the polymethine compound was used in combination with Compound (IV-1) had high sensitivity in comparison with Sample 10 which does not contain Compound (IV-1). When Sample 11 was stored under high temperature and humidity conditions (80% RH, 50° C.) or under an oxygen partial pressure of 10 atom, the degree of the lowering in sensitivity was further reduced in comparison with Sample 10. When Compound (V-3) was used in place of Compound (V-2), similar results were obtained. These compounds have a similarly favorable effect on polymethine compounds other than those of the present invention. However, when these compounds are used in combination with the polymethine compounds of the present invention, sensitivity in particular can be increased, and sensitivity can be greatly prevented from being lowered even under the above storage conditions.

EXAMPLE 7

An aqueous solution containing one kg of $AgNO_3$and an aqueous solution containing 161 g of KBr and 205 g of NaCl were simultaneously added to an aqueous solution containing 72 g of gelatin and 16 g of NaCl at a constant flow rate over a period of 32 minutes (Br=23 mol %).

Rhodium chloride and $K_3IrCl_6$ were added to the above aqueous gelatin solution over a period of 10 minutes in the first half of the above addition, each being used in an amount of $5\times10^{-7}$ mol per mol of Ag. Soluble salts were then removed, and gelatin was added thereto. The pH of the resulting emulsion was adjusted to 6.0, and the pAg thereof was adjusted to 7.5. Subsequently, chloroauric acid and hypo were added thereto, and chemical sensitization was carried out at 60° C. The time of chemical sensitization was chosen so as to impart the highest sensitivity. 4-hydroxy-6-methyl-1,3,3a,7-tetrazaindene was added to the emulsion as a stabilizer and phenoxyethanol was added to the emulsion as an antiseptic.

Several one kg portions were taken from the thus-obtained emulsion. To each one kg emulsion portion, there were added 110 ml of a 0.05% solution of a sensitizing dye of general formula (I) as shown in Table 5, 60 ml of a 0.5% methanol solution of Compound (V-1), 35 ml of a 0.5% methanol solution of Compound (V-2) and 42 ml of a 0.5% methanol solution of Compound (IV-1). The structures of Compounds (V-I), (V-2) and (IV-1) are shown in Example 6. Subsequently, hydroquinone (100 mg/m$^2$), polyethyl acrylate latex (in a weight ratio of 25% based on the amount of gelatin binder) as a plasticizer and 2-bis(vinylsulfonylacetamido)ethane (85 mg/m$^2$) as a hardening agent were added thereto. The resulting emulsion was coated on a polyester support in such an amount as to give a coating weight of 3.7 g/m$^2$ in terms of silver. The coating weight of gelatin was 2.0 g/m$^2$.

A protective layer comprising gelatin (0.8 g/m$^2$), polymethyl methacrylate having an average particle size of 2.5 μm (40 mg/m$^2$) as a matting agent, colloidal silica having an average particle size of 4 μm (30 mg/m$^2$), silicone oil (80 mg/m$^2$), sodium dodecylbenzenesulfonate (80 mg/m$^2$) as a coating aid, the Surfactant (1) having the structural formula shown below, polyethyl acrylate latex (150 mg/m$^2$) and a potassium salt of 1,1'-disulfobutyl-3,3,3',3'-tetramethyl-5,5'-disulfoindotricarbocyanine (6 mg/m$^2$) was coated on the emulsion layer.

The following back layer and back protective layer were coated on the side of the support opposite to the emulsion layer.

| | |
|---|---|
| Black layer | |
| Gelatin | 2.4 g/m$^2$ |
| Sodium dodecylbenzenesulfonate | 60 mg/m$^2$ |
| Dye (2) | 80 mg/m$^2$ |
| Dye (3) | 30 mg/m$^2$ |
| Potassium salt of 1,1'-disulfobutyl-3,3,3',3'-tetramethyl-5,5'-disulfo-indotricarbocyanine | 80 mg/m$^2$ |
| 1,3-Divinylsulfonyl-2-propanol | 60 mg/m$^2$ |
| Polypotassium vinylbnezenesulfonate | 30 mg/m$^2$ |
| Back protective layer | |
| Gelatin | 0.75 g/m$^2$ |
| Polymethyl methactylate (average particle size: 3.5 μm) | 40 mg/m$^2$ |
| Sodium dodecylbenzenesulfonate | 20 mg/m$^2$ |
| Surfactant (1) | 2 mg/m$^2$ |
| Silicone oil | 100 mg/m$^2$ |

Surfatant (1): $C_8F_{17}SO_2N(C_3H_7)-CH_2COOK$

Dye (2):

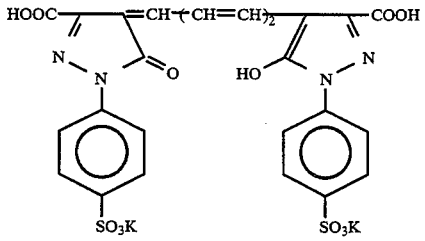

Dye (3):

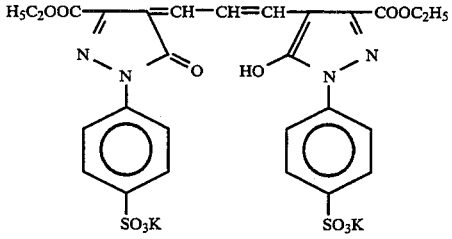

Each of the thus-prepared samples was divided into three groups. One group was stored at a temperature of −30° C. for one year. Another group was stored under natural environmental conditions for one year. Still another group was stored at a temperature of −30° C. and then stored at 80% RH and 50° C. for 3 days before exposure. These three groups were then subjected to scanning exposure using a semiconductor laser which emitted light having a wavelength of 780 nm. The exposed samples were developed, fixed, rinsed and dried using the following developing solution and fixing solution and an automatic processor FG-310 PTS manufactured by Fuji Photo Film Co., Ltd. under conditions of 38° C. and 14 sec. Sensitometry was then conducted.

The reciprocal of the exposure amount giving a density of 3.0 was defined as the sensitivity. With regard to the samples stored at −30° C., the sensitivity is shown in Table 5 in terms of the relative sensitivity when the sensitivity of Sample 1 is taken as 100. With regard to the samples stored at 80% RH and 50° C. and the samples stored under natural environmental conditions, the sensitivity is shown in terms of the relative sensitivity when the sensitivity of each corresponding sample stored at −30° C. is taken as 100.

| Formulation of developing solution | |
|---|---|
| Water | 720 ml |

-continued

| | |
|---|---|
| Disodium ethylenediaminetetraacetate | 4 g |
| Sodium hydroxide | 44 g |
| Sodium sulfite | 45 g |
| 2-Methylimidazole | 2 g |
| Sodim carbonate | 26.4 g |
| Boric acid | 1.6 g |
| Potassium bromide | 1 g |
| Hydroquinone | 36 g |
| Diethylene glycol | 39 g |
| 5-Methylbenztriazole | 0.2 g |
| Pyrazone | 0.7 g |
| Water to make | 1 liter |
| Formulation of fixing solution | |
| Ammonium thiosulfate | 170 g |
| Sodium sulfite (anhydrous) | 15 g |
| Boric acid | 7 g |
| Glacial acetic acid | 15 ml |
| Potash alum | 20 g |
| Ethylenediaminetetraacetic acid | 0.1 g |
| Tartaric acid | 3.5 g |
| Water to make | 1 liter |

TABLE 5

| Sample No. | Polymethine dye and amount added $\times 10^{-5}$ mol/mol of Ag | Stored at −30° C. Sensitivity | Fog | Stored at 80% RH, 50° C. for 3 days Relative sensitivity | Fog | Stored under natural conditions for one year Relative sensitivity | Fog | |
|---|---|---|---|---|---|---|---|---|
| 1 | C-1 70 | 100 (standard) | 0.02 | 75 | 0.02 | 71 | 0.02 | Comparison |
| 2 | I-10 70 | 123 | 0.02 | 93 | 0.02 | 91 | 0.02 | Invention |
| 3 | C-9 1.0 | 91 | 0.02 | 54 | 0.04 | 54 | 0.03 | Comparison |
| 4 | I-19 1.0 | 112 | 0.02 | 87 | 0.03 | 89 | 0.02 | Invention |
| 5 | C-10 1.0 | 98 | 0.02 | 69 | 0.02 | 71 | 0.02 | Comparison |
| 6 | I-18 1.0 | 120 | 0.02 | 96 | 0.02 | 93 | 0.02 | Invention |

C-9

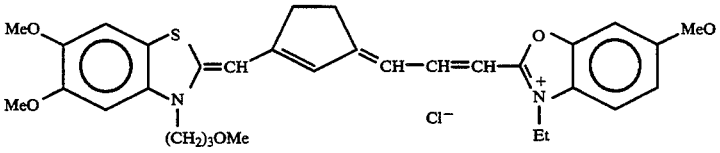

C-10

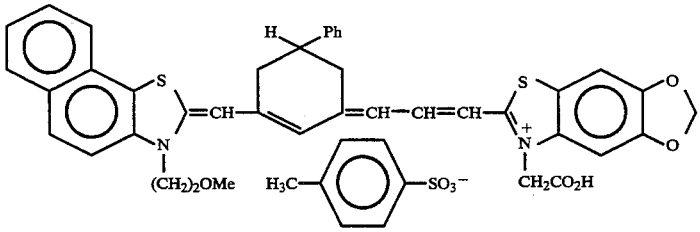

It can be seen from Table 5 that the sensitizing dyes of the present invention have high sensitivity and high storage stability.

It will be understood from Examples 2, 3, 4, 5, 6 and 7 that the methine compounds of the present invention have high sensitivity and are very stable under severe conditions.

While the present invention has been described in detail and with reference to specific embodiments thereof, it will be apparent to one skilled in the art that various changes and modifications can be made therein without departing from the spirit and scope of the present invention.

What is claimed is:

1. A silver halide light-sensitive material containing at least one methine compound selected from the group consisting of methine compounds represented by formulas (I), (II) and (III):

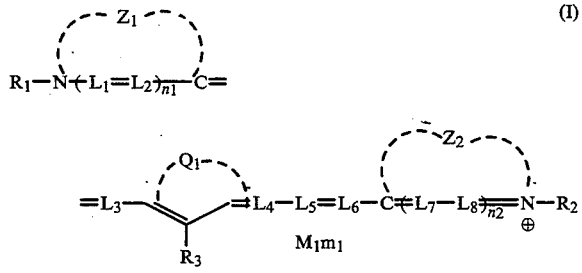

(I)

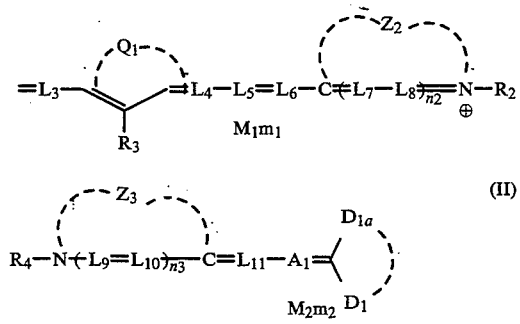

(II)

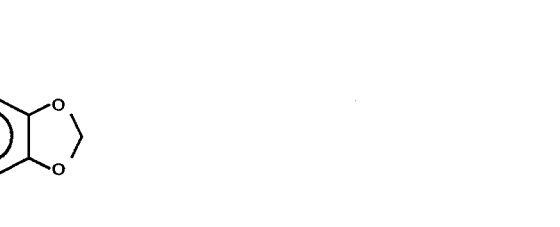

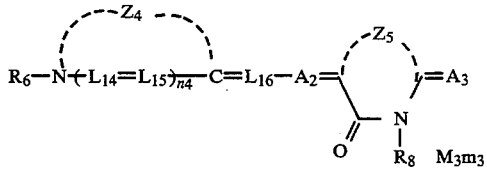

(III)

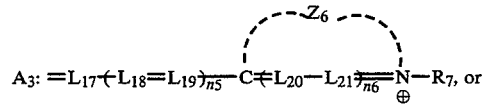

-continued

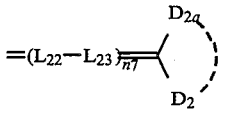

wherein $Z_1$, $Z_2$, $Z_3$, $Z_4$ and $Z_6$ each represents a group of atoms required for forming a five- or six-membered nitrogen-containing heterocyclic ring; $Z_5$ represents a group of atoms required for forming a five-membered or six-membered nitrogen-containing heterocyclic ring; $R_1$, $R_2$, $R_4$, $R_6$ and $R_7$ each represents an alkyl group; $R_3$ represents a substituted or unsubstituted alkyl group; $R_5$ and $R_{5a}$ each represents an alkyl group, an aryl group or a heterocyclic group; $R_8$ represents an alkyl group, an aryl group or a heterocyclic group; $Q_1$, $Q_2$ and $Q_{2a}$ each represents a group of atoms required for forming a five-, six- or seven-membered ring; the moiety consisting of $D_1$ and $D_{1a}$ and the moiety consisting of $D_2$ and $D_{2a}$ each represents a group of atoms required for forming a non-cyclic or cyclic acid nucleus; $L_1$, $L_2$, $L_3$, $L_4$, $L_5$, $L_6$, $L_7$, $L_8$, $L_9$, $L_{10}$, $L_{11}$, $L_{12}$, $L_{12a}$, $L_{13}$, $L_{13a}$, $L_{14}$, $L_{15}$, $L_{16}$, $L_{17}$, $L_{18}$, $L_{19}$, $L_{20}$, $L_{21}$, $L_{22}$ and $L_{23}$ each represents a methine group; $n_1$, $n_2$, $n_3$, $n_4$ and $n_6$ each represents 0 or 1; $n_5$ and $n_7$ each represents an integer not less than 0; $M_1$, $M_2$ and $M_3$ each represents a counter ion for neutralizing charge; $m_1$, $m_2$ and $m_3$ each represents a number not less than 0 required for neutralizing charge in the molecule; and $A_2$ has the same meaning as $A_1$.

2. A silver halide light-sensitive material as set forth in claim 1, wherein $R_3$ represents an unsubstituted alkyl group.

* * * * *